US008485836B2

(12) United States Patent
Nakamura

(10) Patent No.: US 8,485,836 B2
(45) Date of Patent: Jul. 16, 2013

(54) CONNECTOR WITH SHORT-CIRCUITING TERMINAL

(71) Applicant: Sumitomo Wiring Systems, Ltd., Yokkaichi (JP)

(72) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/652,653

(22) Filed: Oct. 16, 2012

(65) Prior Publication Data

US 2013/0040488 A1 Feb. 14, 2013

Related U.S. Application Data

(62) Division of application No. 13/227,672, filed on Sep. 8, 2011, now Pat. No. 8,366,493.

(30) Foreign Application Priority Data

Sep. 15, 2010 (JP) ..... 2010-207162
Sep. 15, 2010 (JP) ..... 2010-207165

(51) Int. Cl.
*H01R 29/00* (2006.01)

(52) U.S. Cl.
USPC ..... 439/188

(58) Field of Classification Search
USPC ..... 439/188, 108, 752
See application file for complete search history.

(56) References Cited

U.S. PATENT DOCUMENTS

| | | | | |
|---|---|---|---|---|
| 5,462,449 | A * | 10/1995 | Tsuji et al. | 439/188 |
| 5,588,855 | A * | 12/1996 | Nankoh | 439/188 |
| 6,010,343 | A * | 1/2000 | Konoya et al. | 439/144 |
| 6,036,515 | A * | 3/2000 | Nakamura | 439/188 |
| 6,241,542 | B1 * | 6/2001 | Nishide et al. | 439/188 |
| 6,368,164 | B1 | 4/2002 | Nakamura | |
| 6,443,747 | B2 * | 9/2002 | Saba | 439/188 |
| 6,638,109 | B2 | 10/2003 | Kurimoto et al. | |
| 6,805,592 | B2 | 10/2004 | Kurimoto | |
| 7,476,123 | B2 | 1/2009 | Kobayashi et al. | |
| 7,556,538 | B2 | 7/2009 | Nakamura | |
| 7,901,229 | B2 | 3/2011 | Nakamura | |
| 8,011,977 | B2 * | 9/2011 | Tsuruta et al. | 439/752 |

* cited by examiner

*Primary Examiner* — Chandrika Prasad
(74) *Attorney, Agent, or Firm* — Gerald E. Hespos; Michael J. Porco; Matthew T. Hespos

(57) ABSTRACT

A connector has a first housing (10), a pair of first terminal fittings (50) accommodated in parallel with each other inside the first housing (10), a short-circuiting terminal (40) mounted inside the first housing (10) and short-circuiting a pair of the first terminal fittings (50), and a sub-housing (30) having insulating properties and holding the short-circuiting terminals (40). An accommodation chamber (17) formed inside the first housing (10) is open on an outer side surface of the first housing (10) as a mounting/removing opening (18). The sub-housing (30) is inserted into the accommodation chamber (17) in almost parallel with a direction in which a pair of the first terminal fittings (50) is arranged.

15 Claims, 21 Drawing Sheets

CONNECTOR WITH SHORT-CIRCUITING TERMINAL

CROSS REFERENCE TO RELATED APPLICATION

This application is a divisional of U.S. patent application Ser. No. 13/227,672 filed Sep. 8, 2011.

BACKGROUND OF THE INVENTION

1. Field of the Invention

The invention relates to a connector.

2. Description of the Related Art

U.S. Pat. Nos. 7,556,538 and 7,901,229 disclose a connector assembly with first and second housings that can be fit together. The first housing has male terminal fittings arranged in a left to right direction. The second housing has female terminal fittings mounted in positions to mate with the male terminal fittings when the housings are fit together.

The first housing has a hood surrounding tabs at the front ends of the male terminal fittings. A retainer is mounted in the first housing and prevents the male terminal fitting from being removed from the first housing. The second housing has a terminal fitting accommodation part accommodating the second terminal fittings and a tubular fit-on part surrounding the terminal fitting accommodation part. The terminal fitting accommodation part fits in the hood and the tubular fit-on part fits on the hood when the housings are connected.

The retainer is mounted in the first housing in a direction intersecting the direction in which the first and second housings are fit together. An extended detection part is cantilevered on the retainer and functions to detect the mounted state of the retainer. The extended detection part is almost flush with the outer surface of the hood when the retainer is mounted correctly on the first housing and is at a position where the extended detection part does not interfere with the tubular fit-on part. Thus both housings can be fit together without trouble. However, the extended detection part interferes with the tubular fit-on part while fitting the housings together if the retainer is not mounted correctly in the first housing. Thus the operation of fitting both housings on each other is prevented from being performed.

The first housing also has an accommodation chamber for accommodating a short-circuiting terminal disposed for short-circuiting a pair of the terminal fittings. The accommodation chamber has a mounting/removing opening that is open on an outer side surface of the housing. The short-circuiting terminal is mounted in the housing in a direction parallel with the direction in which the terminal fittings are arranged.

The extended detection part of the retainer is cantilevered and plate-shaped. Thus, the end of the extended detection part is liable to shift in the retainer-mounting direction. Accordingly, there is a fear that the extended detection part will interfere with the tubular fit-on part while fitting the housings together even though the retainer is mounted correctly.

The above-described construction also is problematic when a plurality of pairs of terminal fittings are arranged in a row, and plural short-circuiting terminals are provided to short-circuit the respective pairs of the terminal fittings. More particularly, it is necessary to form a locking part to hold the short-circuiting terminals at predetermined positions so that the short-circuiting terminals do not contact each other. However, the short-circuiting terminals cannot move past the locking part in the direction in which the short-circuiting terminals are inserted into the accommodation chamber and the direction in which the short-circuiting terminals are removed therefrom. Thus, plural short-circuiting terminals cannot be inserted sequentially into the accommodation chamber from one mounting/removing opening.

The above-described problems caused by the locking part can be solved by forming two accommodation chambers partitioned from each other with a partitioning wall and by forming separate mounting/removing openings on the left and right outer side surfaces of the housing for the respective accommodation chambers. However, it is necessary to close the mounting/removing opening with a cover after the short-circuiting terminals are inserted into the accommodation chamber to prevent foreign matter from interfering with the short-circuiting terminals after the short-circuiting terminals are inserted into the accommodation chamber. Thus two covers are required for two accommodation chambers and the number of parts is increased.

The invention has been completed based on the above-described situation. It is an object of the invention to improve reliability of the detection function to be performed by the extended detection part of the retainer.

It is also an object of the invention to dispose short-circuiting terminals parallel with a direction in which a row of terminal fittings are arranged so that pairs of the terminal fittings can be short-circuited by the short-circuiting terminals.

SUMMARY OF THE INVENTION

The invention relates to a connector assembly with first and second housings that can be fit together. Each housing is formed from a non-conductive material. The first housing is formed with a hood. The second housing has a terminal fitting accommodation part that can fit in the hood and a tubular fit-on part that can fit externally on the hood.

Male terminal fittings are mounted in the first housing and have tabs that project forward into the hood. Female terminal fittings are accommodated in the terminal fitting accommodation part of the second housing and mate with the male terminal fittings when the first and second housings are fit together.

A retainer is mounted on the first housing in a direction intersecting a direction in which the first and second housings are fit together. The retainer functions to prevent the male terminal fittings from being removed from the first housing. A plate-shaped extended detection part is cantilevered on the retainer and is accommodated inside the tubular fit-on part when the first and second housings are fit together. The extended detection part interferes with the tubular fit-on part if an attempt is made to fit the housings together while the retainer remains incorrectly mounted on the first housing. A fit-on concave part is formed to open on an outer surface of the first housing. A fit-on convex part is formed on the extended detection part and can fit in the fit-on concave part to prevent the fit-on convex part from inclining.

The proximal end of the extended detection part inclines its posture when the end of the extended detection part is displaced incorrectly in the retainer-mounting direction. Thus, it is possible to prevent the end of the extended detection part from being displaced incorrectly by preventing the posture of the extended detection part from inclining. Focusing on this point, the subject invention fits the fit-on convex part of the extended detection part in the fit-on concave part to prevent the fit-on convex part from inclining relative to the fit-on concave part and thereby preventing the extended detection part from inclining relative to the first housing. As a result, the end of the extended detection part is prevented with certainty from being displaced incorrectly to enhance the reliability of the detection function performed by the detection extended part.

An accommodation chamber is formed inside the first housing and opens on the outer surface of the first housing at a mounting/removing opening. The connector assembly also includes a sub-housing that is formed from an insulting material and is inserted into the accommodation chamber at the mounting/removing opening. The fit-on concave part is defined by a gap between an inner surface of the accommodation chamber and an outer surface of the sub-housing. As a result, it is possible to make the configuration of the outer surface of the first housing simpler than a connector with a dedicated fit-on concave part.

An elastically flexible locking part preferably is formed on the outer surface of the sub-housing or the inner surface of the accommodation chamber for holding the sub-housing inside the accommodation chamber. The locking part elastically flexes in a process of inserting the sub-housing into the accommodation chamber and elastically returns to an original state when the sub-housing is inserted correctly into the accommodation chamber. A detection part is formed on the extended detection part and can move into a flexing space of the locking part in a state in which the retainer is mounted correctly on the first housing.

The detection part moves into the flexing space when the locking part elastically returns to the original state and the retainer is mounted correctly on the first housing. However the locking part remains elastically flexed when the retainer is mounted incorrectly on the first housing and the detection part cannot move into the flexing space. Therefore it is possible to detect the mounted state of the sub-housing according to whether the retainer has been mounted correctly on the first housing.

The connector assembly also includes a short-circuiting terminal mounted in the first housing for short-circuiting a pair of the terminal fittings. The short-circuiting terminal is held in the sub-housing. The sub-housing is inserted into the mounting/removing opening in a direction almost parallel with a direction in which the terminal fittings are arranged.

A plurality of pairs of terminal fittings may be arranged in a row and each pair of terminal fittings may require means for being short-circuited. In this situation, the sub-housings are inserted sequentially into one accommodation chamber with the sub-housings individually holding the short-circuiting terminals. The sub-housings inserted into the accommodation chamber can be brought into contact with each other. The sub-housing disposed at the inner side of the accommodation chamber in the insertion direction is prevented from moving inward and the sub-housing disposed in the vicinity of the mounting/removing opening is prevented from being removed from the accommodation chamber. Thus, all of the short-circuiting terminals are placed in position in the direction in which they are mounted in and removed from the accommodation chamber.

The short-circuiting terminal preferably has two elastic contact pieces and a connection part that connects the elastic contact pieces to each other. The connection part is accommodated inside the sub-housing and the elastic contact pieces project out from the sub-housing for contacting two of the terminal fittings. The sub-housing would be large if the sub-housing accommodated the entire short-circuiting terminal. However, the elastic contact piece projects out from the sub-housing. Therefore the sub-housing is compact.

A removal prevention part preferably projects on an outer surface of the sub-housing and is locked to a locking part of the accommodation chamber to prevent the sub-housing from being removed from the accommodation chamber. The removal prevention part preferably is disposed alongside the elastic contact piece. Thus, the removal prevention part prevents the elastic contact piece from being subjected to interference of foreign matter.

Wrong insertion prevention parts preferably are formed on an inner surface of the accommodation chamber and an outer surface of the sub-housing respectively and extend parallel to a direction in which the sub-housing is mounted in the accommodation chamber and removed therefrom. The wrong insertion prevention parts fit together in a concave-convex relationship only when the sub-housing is inserted into the accommodation chamber in a correct positional relationship between the sub-housing and the accommodation chamber.

The convex and concave wrong insertion prevention parts do not fit together during an attempt to insert the sub-housing into the accommodation chamber in an incorrect positional relationship. Accordingly the convex wrong insertion prevention part interferes with the mating member and prevents the improperly oriented sub-housing from being inserted into the accommodation chamber.

DETAILED DESCRIPTION OF THE PREFERRED EMBODIMENTS

Figure 1:
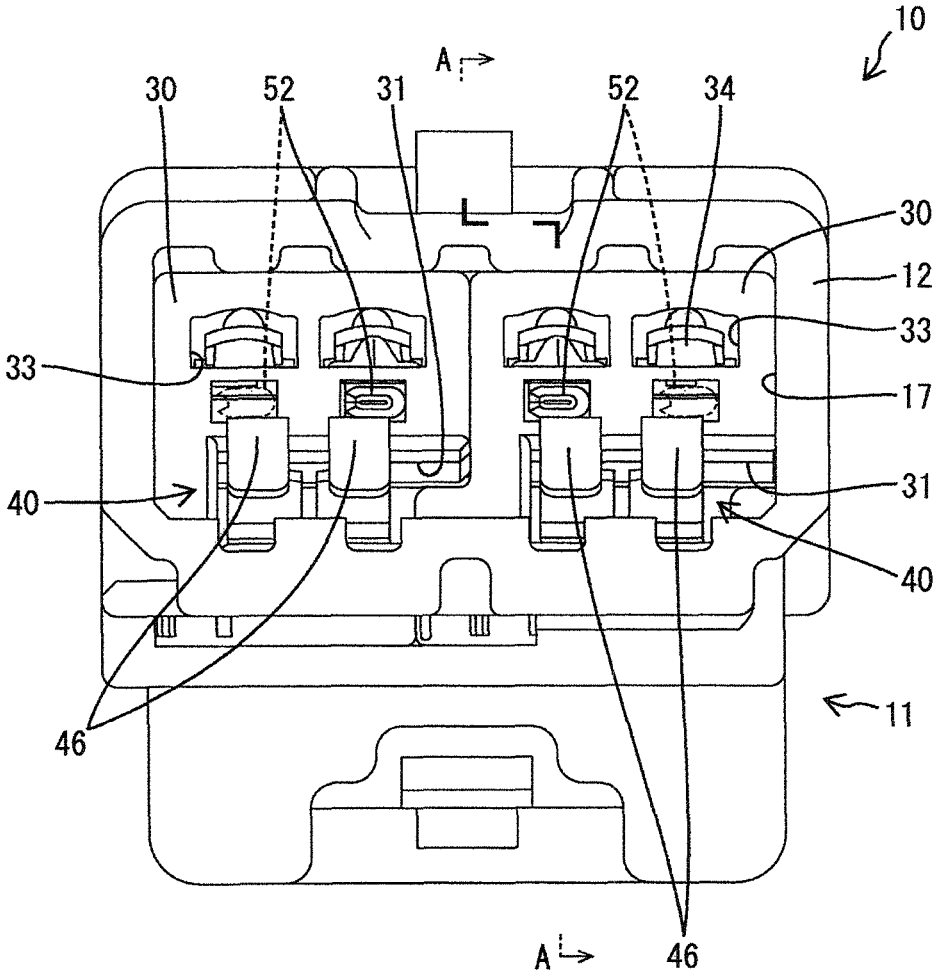
FIG. 1 is a front view of a first housing of an embodiment 1.

A connector assembly in accordance with the invention has first and second housings 10 and 80 that can be fit together. Two sub-housings 30, two short-circuiting terminals 40, two pairs of first terminal fittings 50 and a retainer 60 are mounted on the first housing 10.

Figure 2:
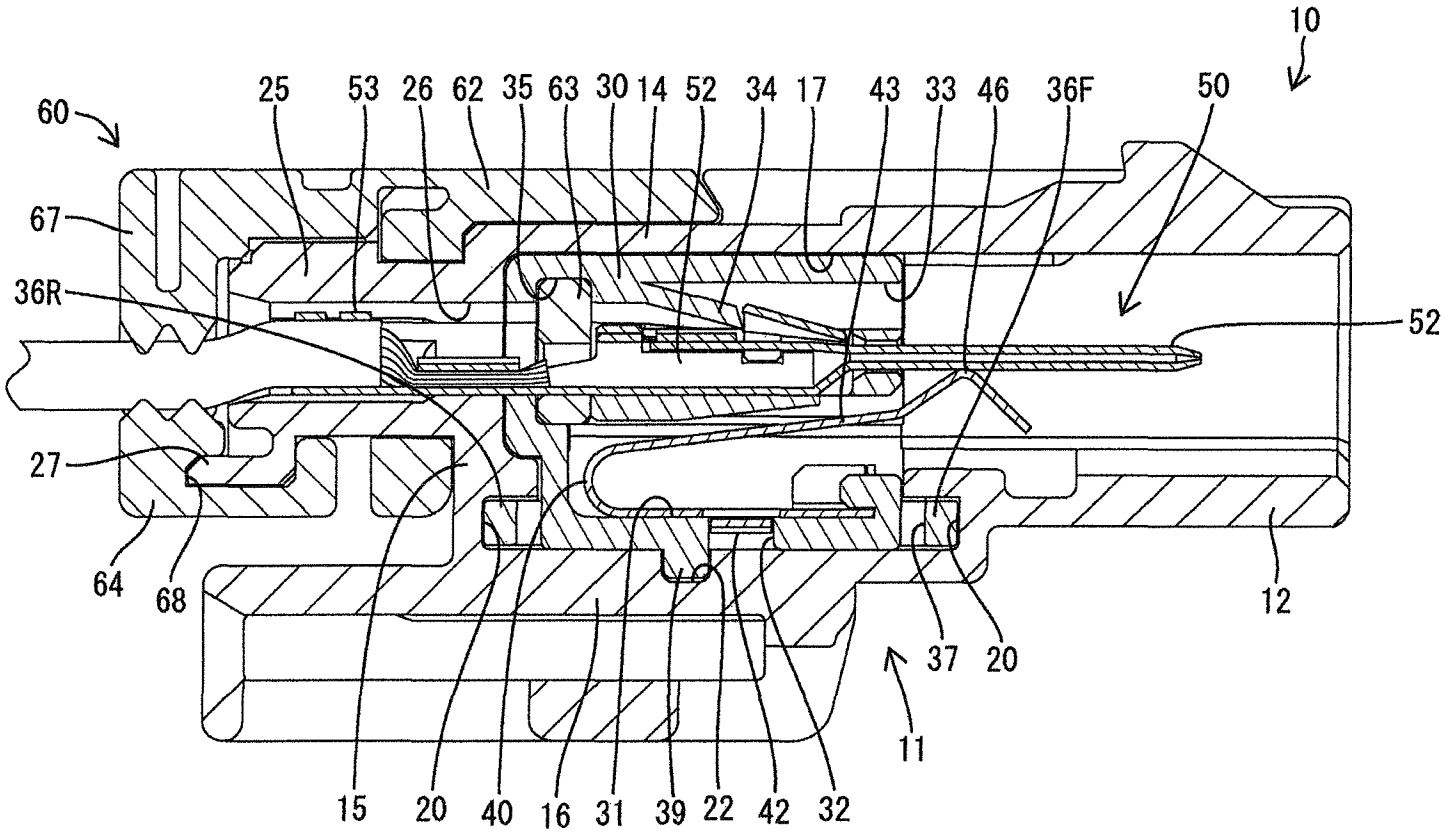
FIG. 2 is a sectional view taken along a line A-A of FIG. 1.
Figure 5:
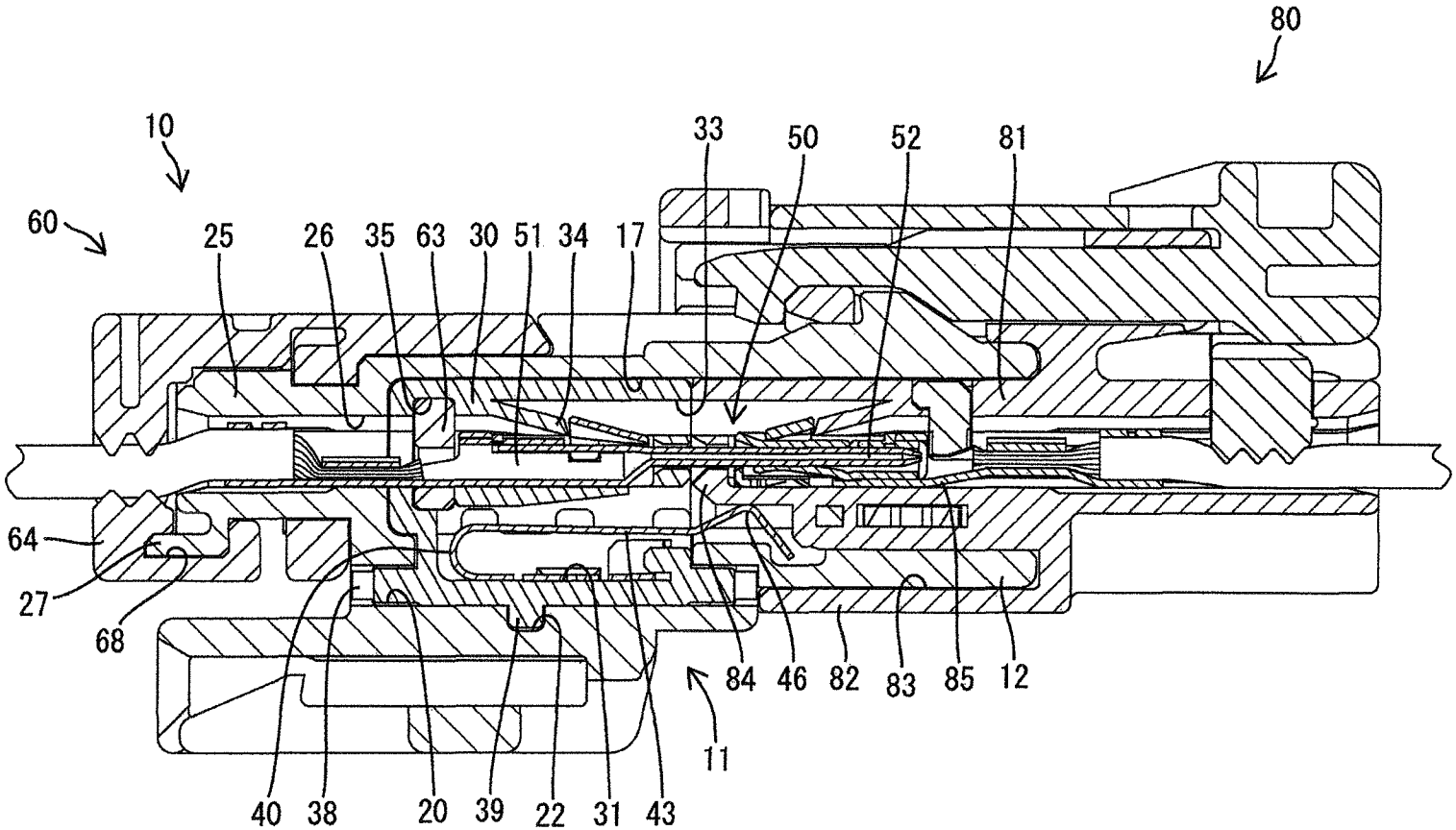
FIG. 5 is a sectional view showing a state in which the first housing and the second housing are fitted on each other.

The first housing 10 is made of synthetic resin. As shown in FIGS. 2 and 5, the first housing 10 is constructed of a terminal fitting holding part 11 and an approximately quadrangular prism-shaped hood 12, integral with the terminal fitting holding part 11. The hood 12 is cantilevered forward (to the right in FIGS. 2 and 5) from a peripheral edge of a front end of the terminal fitting holding part 11. The terminal fitting holding part 11 has a side wall 13, an upper wall 14, a rear wall 15 and a lower wall 16. The side wall 13 is flush and continuous with a rear end of a side surface of the hood 12. The upper wall 14 is perpendicular and continuous with an upper edge of the side wall 13 and is flush continuous with an upper surface of the hood 12. The rear wall 15 is perpendicular to and continuous with a side edge of the side wall 13. The lower wall 16 is perpendicular to and continuous with lower edges of the side wall 13 and the rear wall 15. The lower wall 16 also is parallel to and continuous with a lower surface of the hood 12 so that the lower wall 16 and the lower surface of the hood 12 are stepped from each other.

As described above, the terminal fitting holding part 11 is surrounded with the four walls 13 through 16 and is thus box-shaped. An accommodation chamber 17 is formed inside the terminal fitting holding part 11 for accommodating the sub-housing 30. A front surface of the accommodation chamber 17 communicates with the inside of the hood 12. As shown in FIGS. 7 and 10 through 12, a side surface of the accommodation chamber 17 is open to the outside of the terminal fitting holding part 11. A mounting/removing opening 18 opens sideways into the accommodation chamber 17 for mounting and removing the sub-housing 30 relative to the first housing 10. An open range of the mounting/removing opening 18 in a longitudinal direction that is parallel with the direction in which the housings 10 and 80 are fit together extends to a rear-end of a side surface of the hood 12 and will be covered with a tubular fit-on part 82 of the second housing 80 when housings 10 and 80 are fit together.

Figure 9:
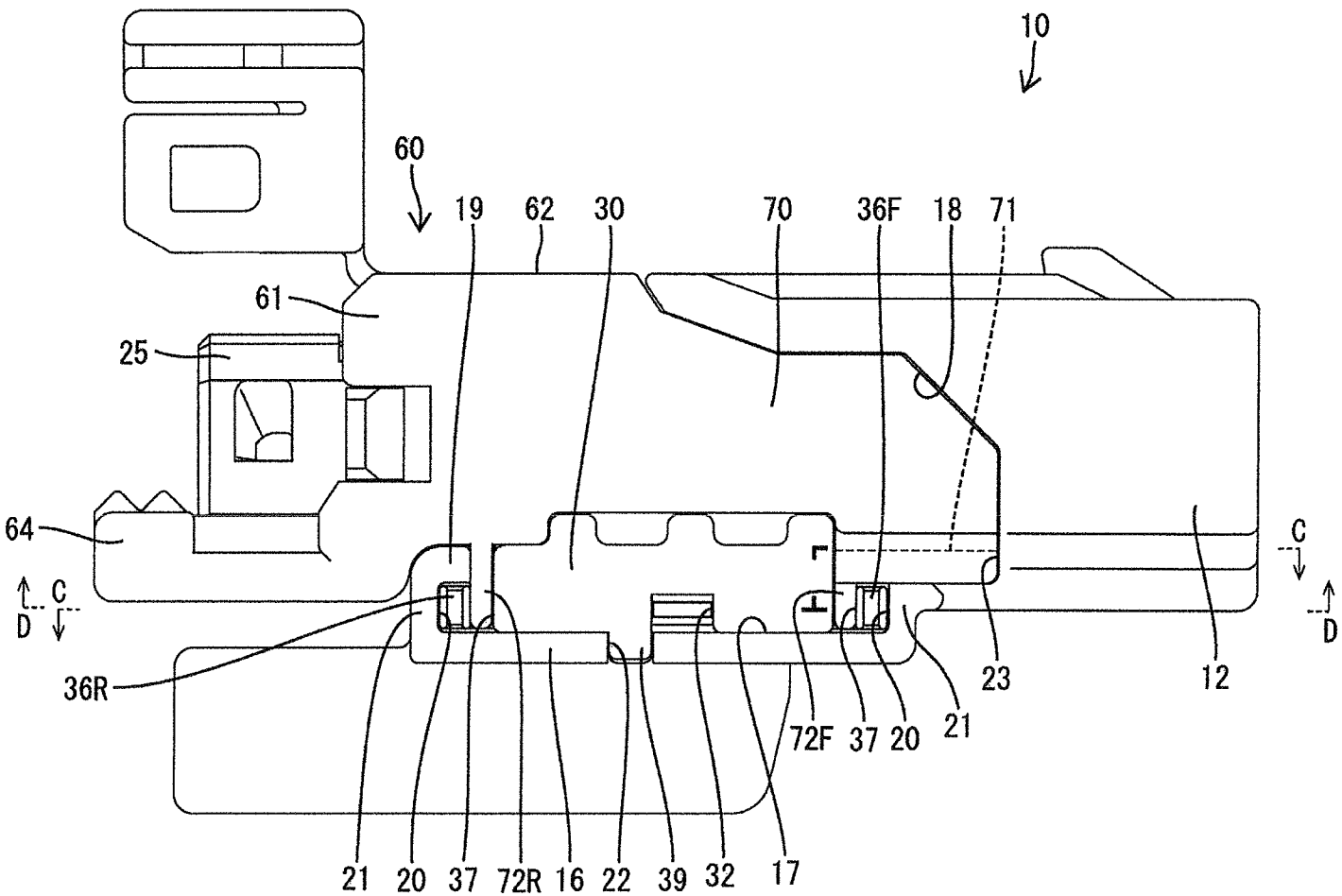
FIG. 9 is a left side view showing a state in which a retainer is mounted on the first housing.
Figure 10:
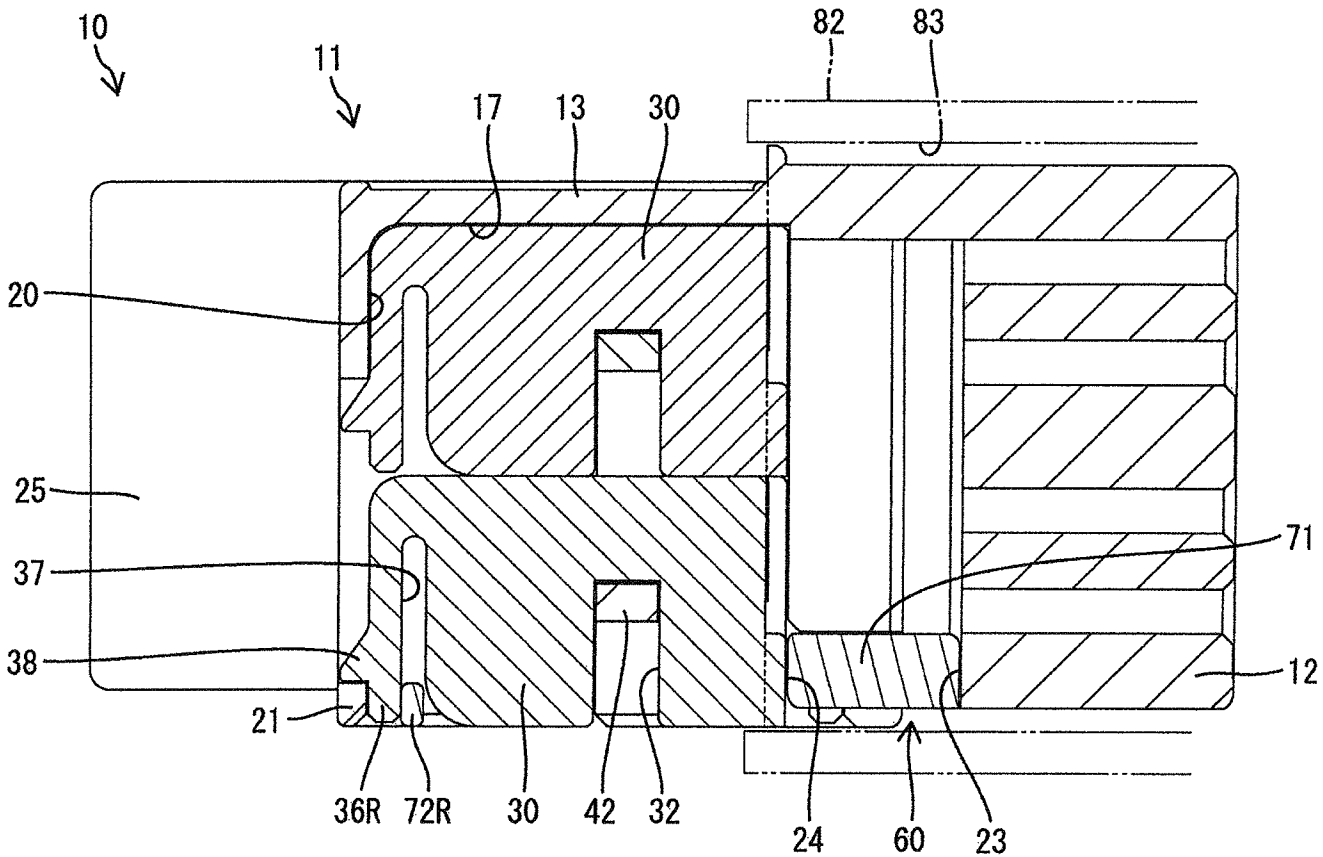
FIG. 10 is a sectional view taken along a line C-C of FIG. 9.
Figure 11:
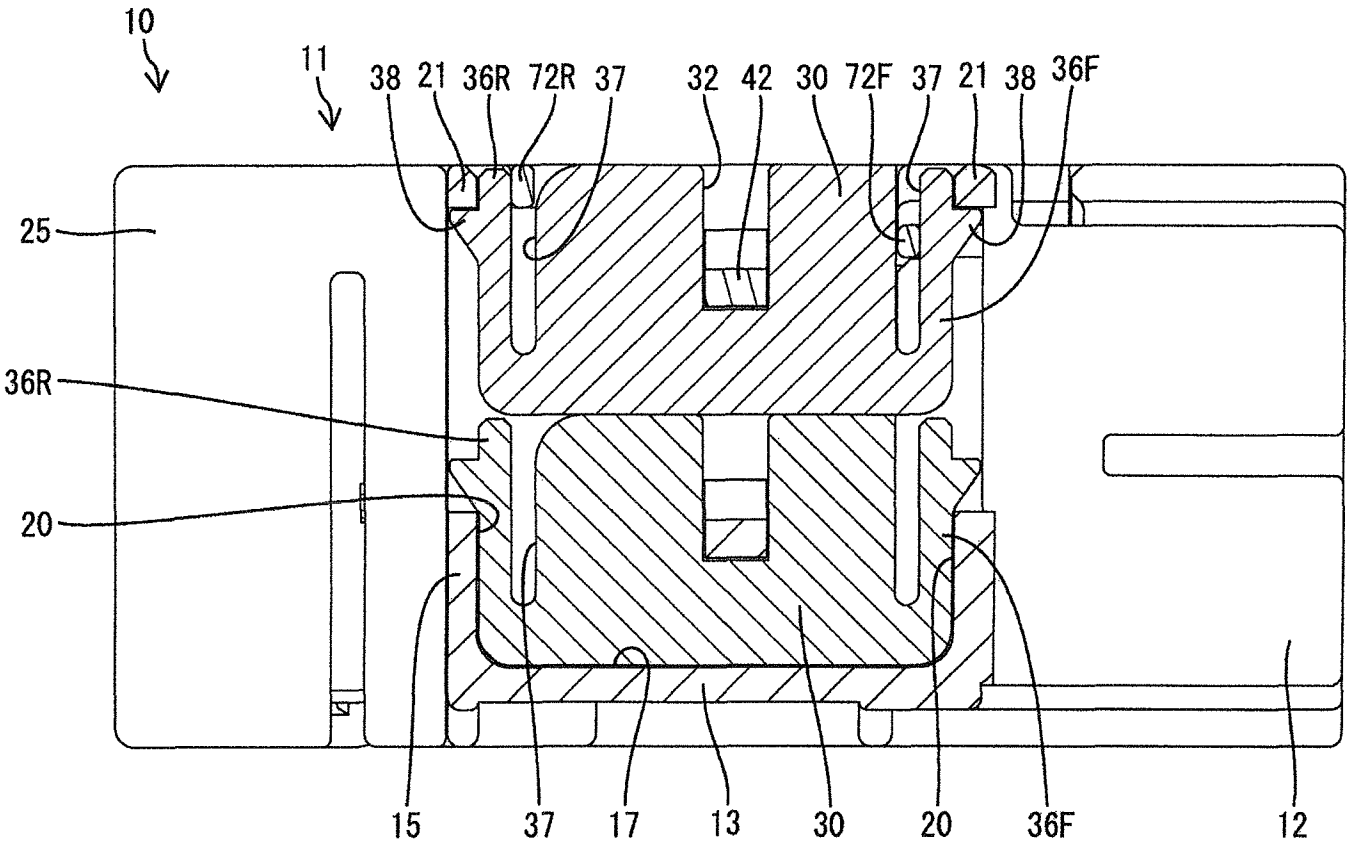
FIG. 11 is a sectional view taken along a line D-D of FIG. 9.

Front and rear guide ribs 19 are formed inside the accommodation chamber 17 at a rear edge of the lower surface of the hood 12 and a lower end of the rear wall 15. The guide ribs 19 extend in a left-to-right direction which is perpendicular to the direction in which the housings 10 and 80 are fit together and parallel with a direction in which the sub-housing 30 is mounted in or removed from the accommodation chamber 17. Front and rear guide grooves 20 are formed between the guide ribs 19 and the lower wall 16. A lock 21 projects from portions of the front and rear guide grooves 20 near the mounting/removing opening 18 as shown in FIGS. 10 and 11. A downwardly concave reinforcing part 22 is formed on the lower wall 16 and extends in the left-to-right direction at a position slightly rearward of an approximately the central position of the lower wall 16 in its longitudinal direction, as shown in FIGS. 2, 5 through 9, and 12.

Figure 6:
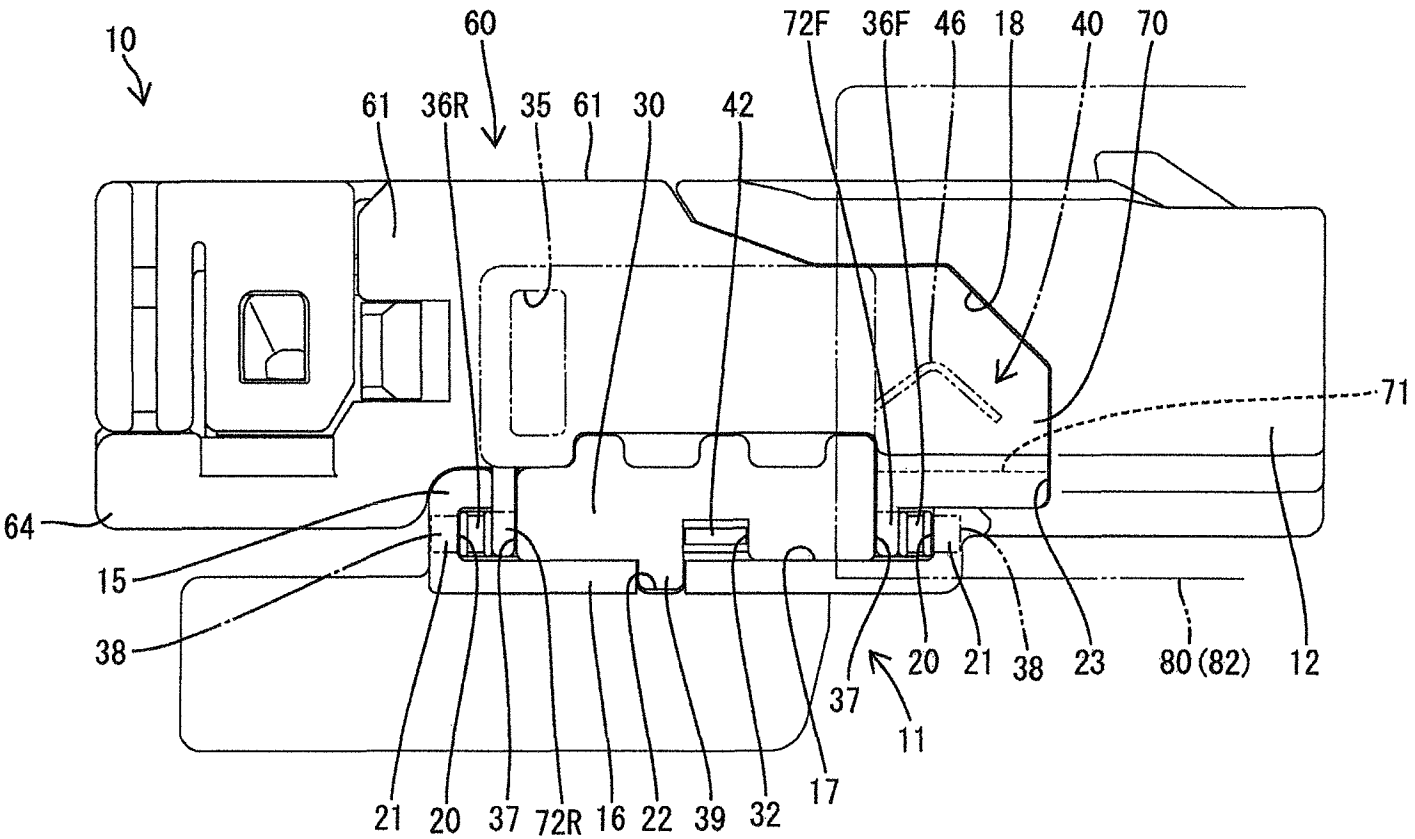
FIG. 6 is a left side view showing the state in which the first housing and the second housing are fitted on each other.
Figure 7:
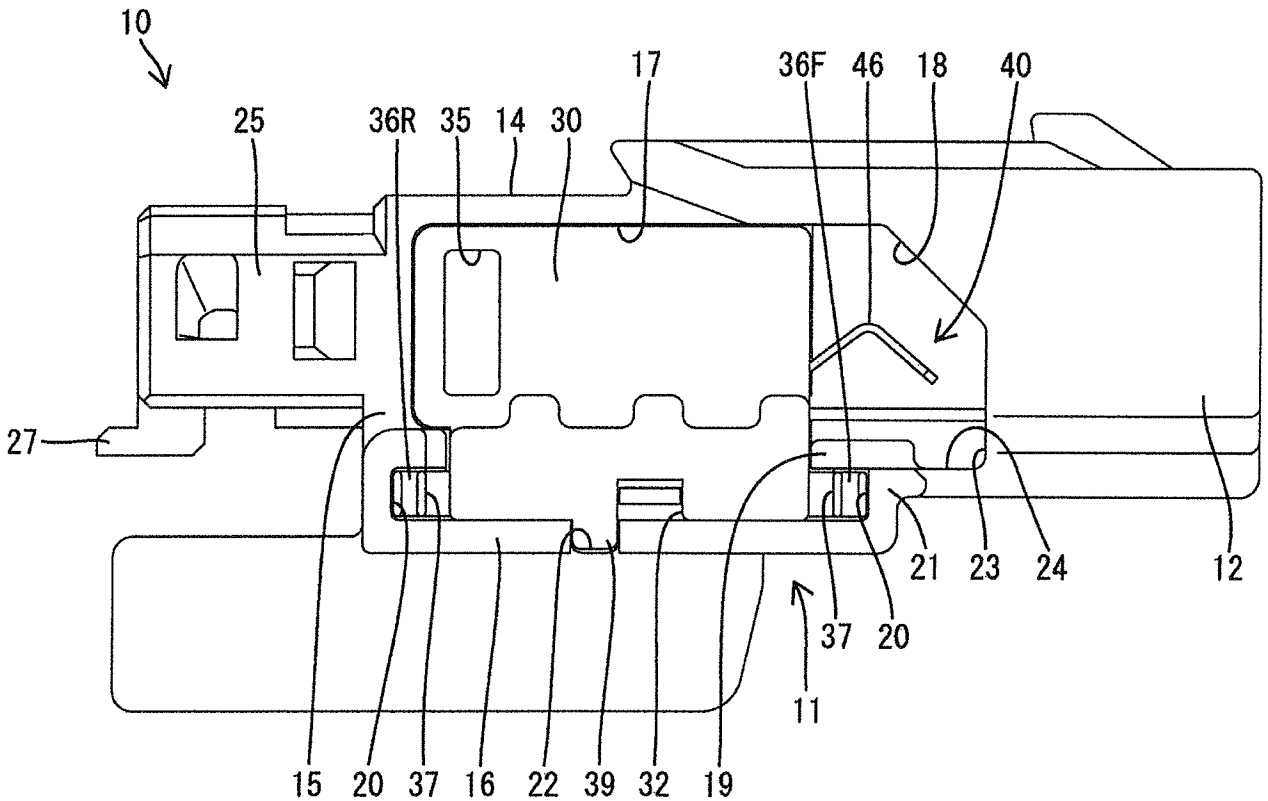
FIG. 7 is a left side view showing the state in which a sub-housing is correctly mounted on the first housing.

A step 23 extends in the left-to-right direction in the rear of the accommodation chamber 17 so that the lower wall 16 of the accommodation chamber 17 and the lower surface of the hood 12 are stepped from each other, as shown in FIGS. 6, 7, 9, 10, and 12. The step 23 and the front-side guide rib 19 are located on almost the same level. The front-side guide rib 19 is cut out near the mounting/removing opening 18 in the left-to-right direction. Thus, a part of a front-end surface of the sub-housing 30 confronts the step 23 in the longitudinal direction when the sub-housing 30 is inserted into the accommodation chamber 17, as shown in FIGS. 7 and 10, and a fit-on concavity 24 is defined in a region of the accommodation chamber 17 between the front-end surface of the sub-housing 30 and the step 23.

Figure 12:
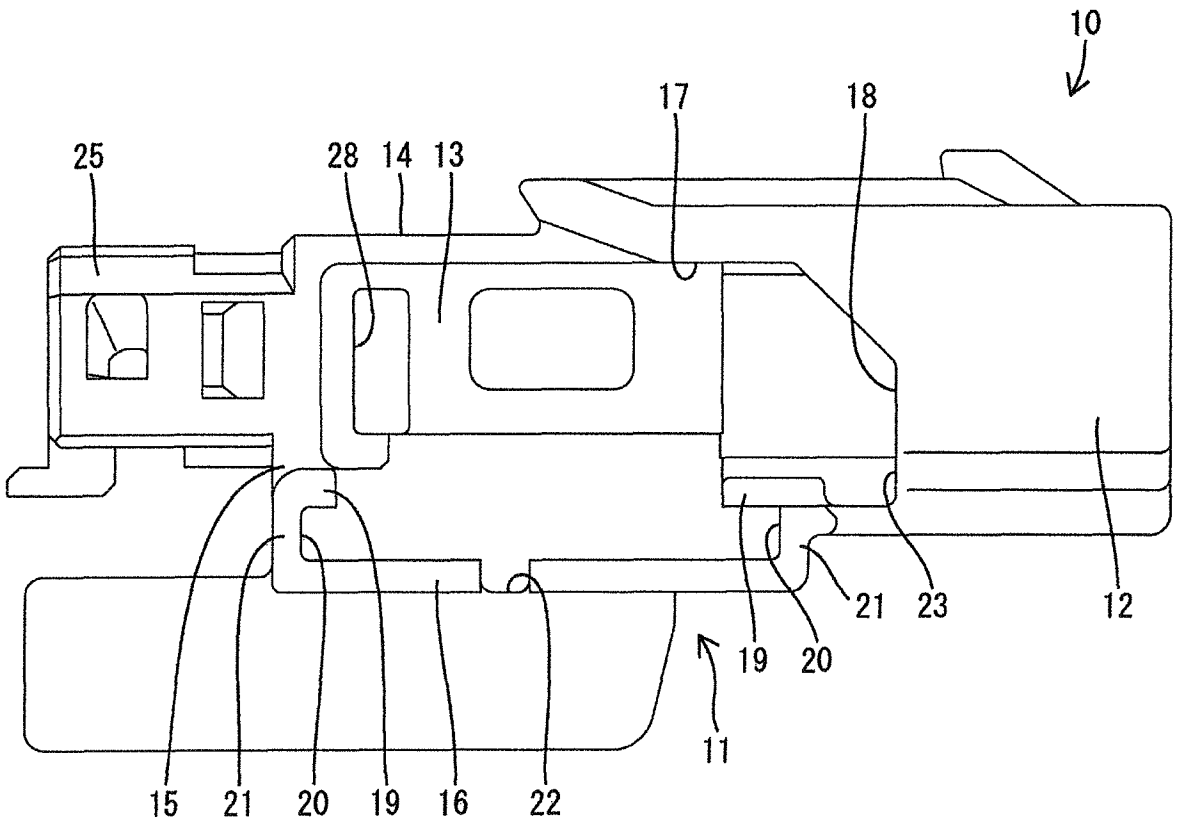
FIG. 12 is a left side view of the first housing.

A block-shaped terminal fitting insertion part 25 projects rearward from a region of the rear wall 15 except a lower-end portion thereof, as shown in FIGS. 5, 7 through 9, and 12. Two pairs of terminal fitting insertion openings 26 penetrate through the terminal fitting insertion part 25 in the longitudinal direction and communicate with the inside of the accommodation chamber 17, as shown in FIGS. 5 and 10. The two pairs of the terminal fitting insertion openings 26 are arranged in a row in the left-to-right direction. A guide rib 27 is formed along the lower edge of the rear-end of the rear wall 15 and extends in the left-to-right direction. As shown in FIG. 12, an escape hole 28 penetrates through a rear-end portion of the side wall 13 in the left-to-right direction.

Figure 13:
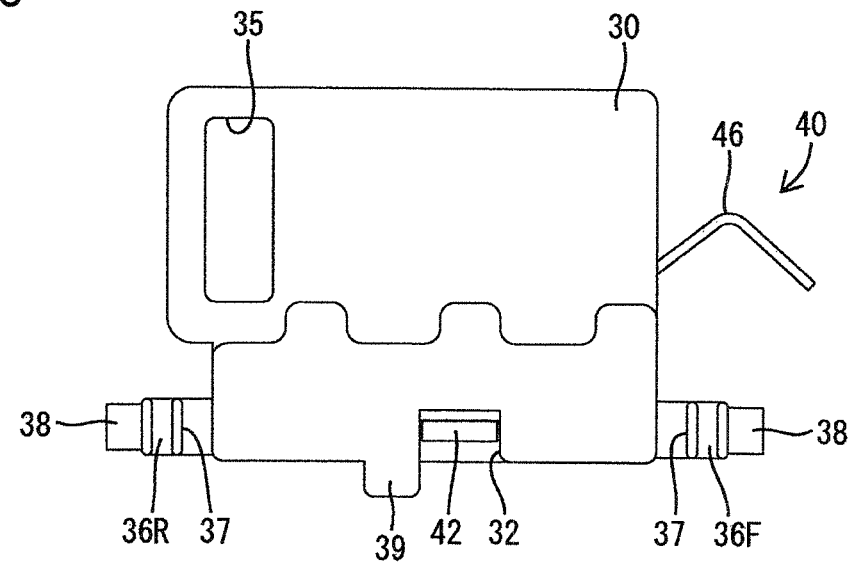
FIG. 13 is a left side view of the sub-housing.
Figure 14:
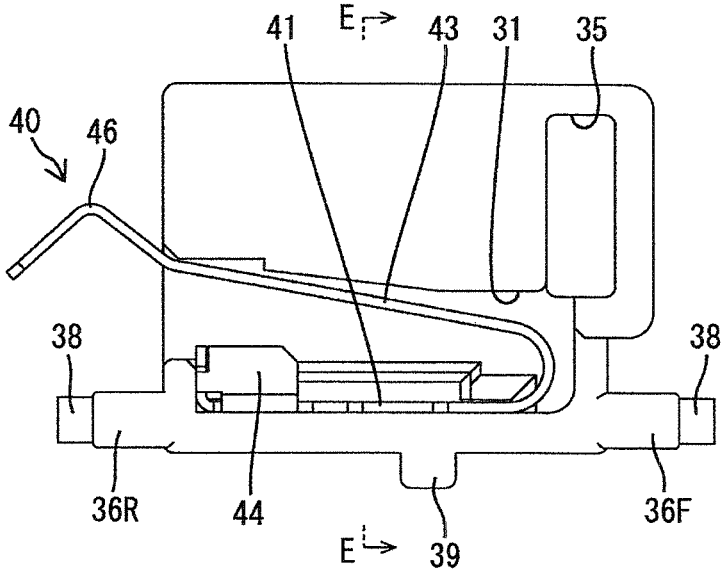
FIG. 14 is a right side view of the sub-housing.
Figure 15:
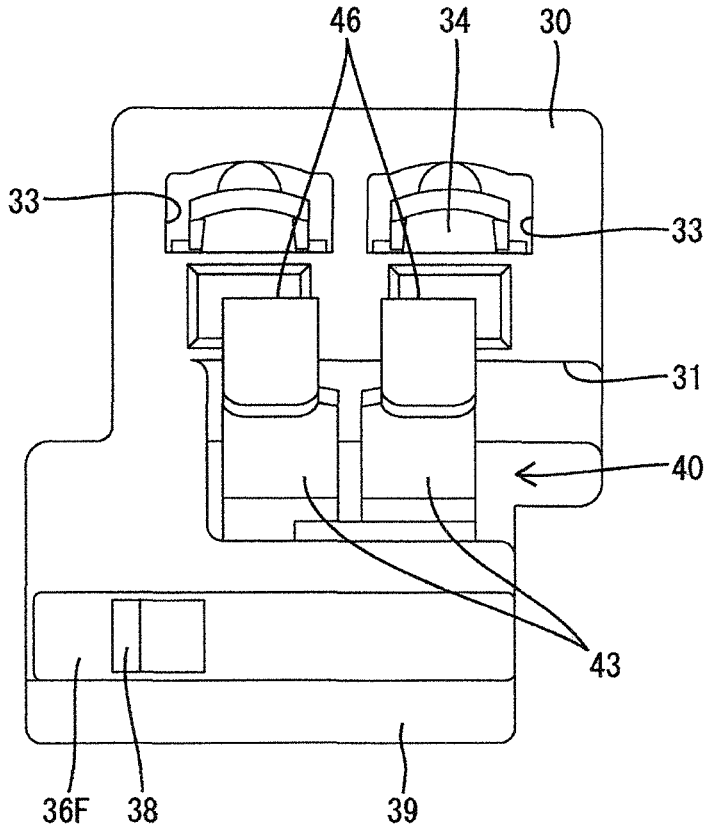
FIG. 15 is a front view of the sub-housing.
Figure 16:
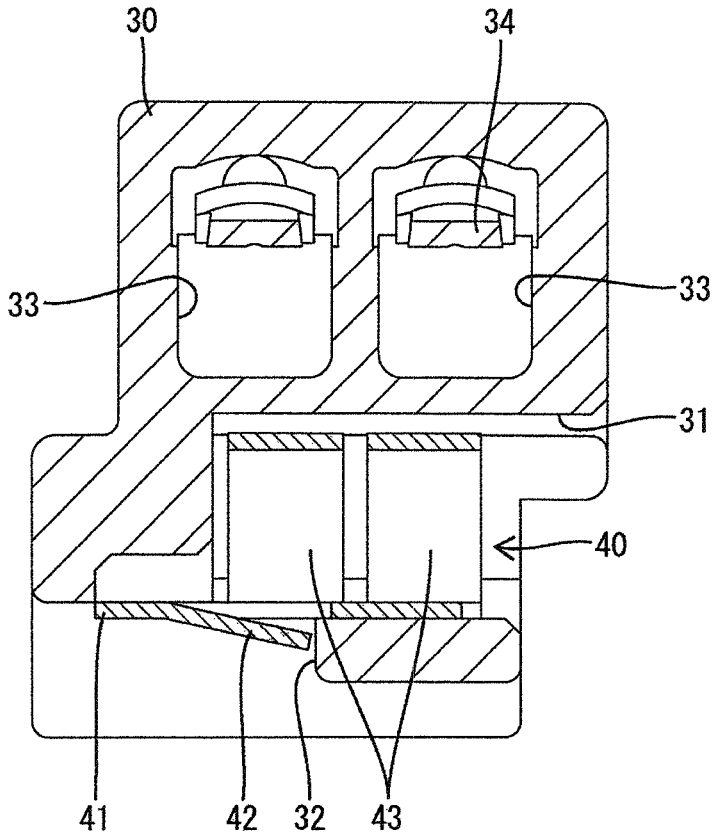
FIG. 16 is a sectional view taken along a line E-E of FIG. 14.
Figure 17:
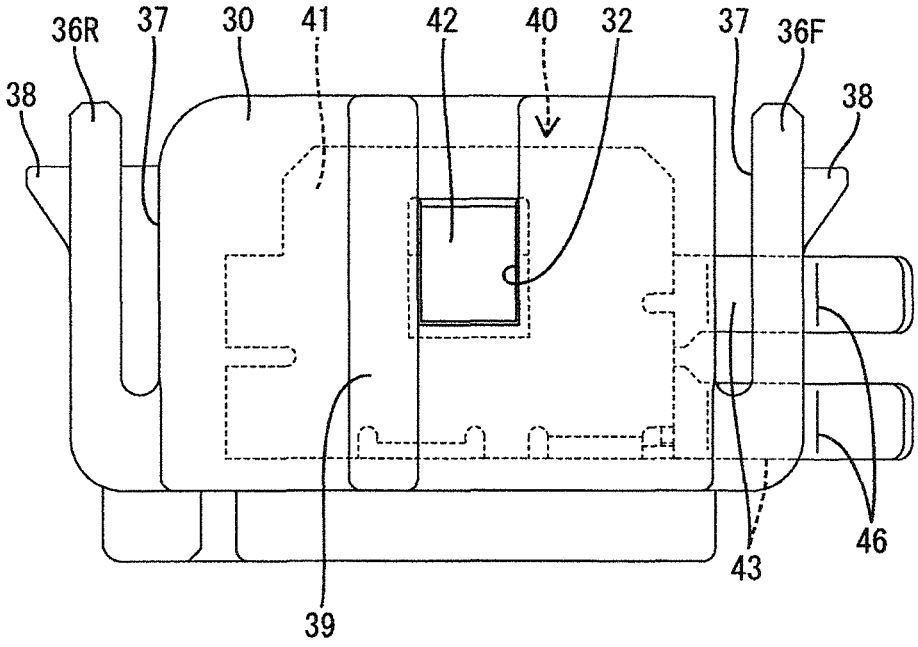
FIG. 17 is a bottom view of the sub-housing.

The sub-housing 30 is made of synthetic resin and has a block shape, as shown in FIGS. 13 through 17. An accommodation concavity 31 is formed inside the sub-housing 30 and open to the side surface that has the mounting/removing opening 18 of the accommodation chamber 17 as shown in FIGS. 14 through 16. A region of a front surface of the accommodation concavity 31 except for a lower end is open to a front-end surface of the sub-housing 30. A locking hole 32 is formed on a bottom surface of the sub-housing 30 and communicates with the accommodation concavity 31, as shown in FIGS. 16 and 17.

Left and right terminal fitting accommodation holes 33 penetrate longitudinally through a part of the sub-housing 30 above the accommodation concavity 31 as shown in FIGS. 2, 5, 15, and 16. A lance 34 is cantilevered forward from a ceiling surface of the terminal fitting accommodation hole 33, as shown in FIGS. 2 and 5, and can flex elastically in a vertical direction. A through-hole 35 penetrates through the sub-housing 30 in the left-to-right direction and communicates with a rear end of the terminal fitting accommodation hole 33.

As shown in FIGS. 13, 14, and 17, two locking parts 36F, 36R are formed along a lower-end portion of front and rear end surfaces of the sub-housing 30. The locking parts 36F, 36R are cantilevered laterally to a side opposite to a side where the accommodation concavity 31, as shown in FIGS. 10 and 11. The locking parts 36F, 36R are longitudinally elastically flexible toward the sub-housing 30. A flexing space 37 is formed between an outer surface of the sub-housing 30 and the locking parts 36F, 36R to permit the elastic deformation of the locking parts 36F, 36R. A locking projection 38 projects from a surface of each of the locking parts 36F, 36R opposite to the front and rear surfaces of the sub-housing 30. A prevention rib 39 extends in the left-to-right direction on a bottom surface of the sub-housing 30.

Figure 18:
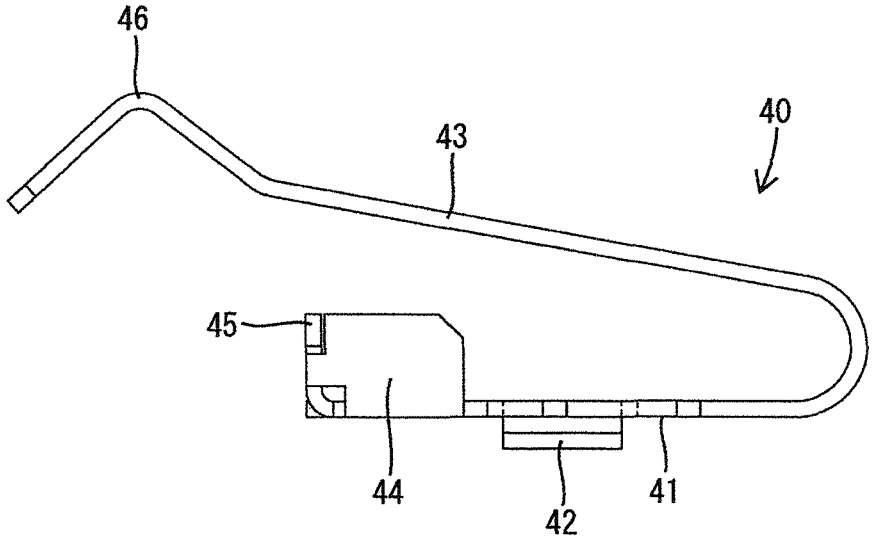
FIG. 18 is a right side view of a short-circuiting terminal.
Figure 19:
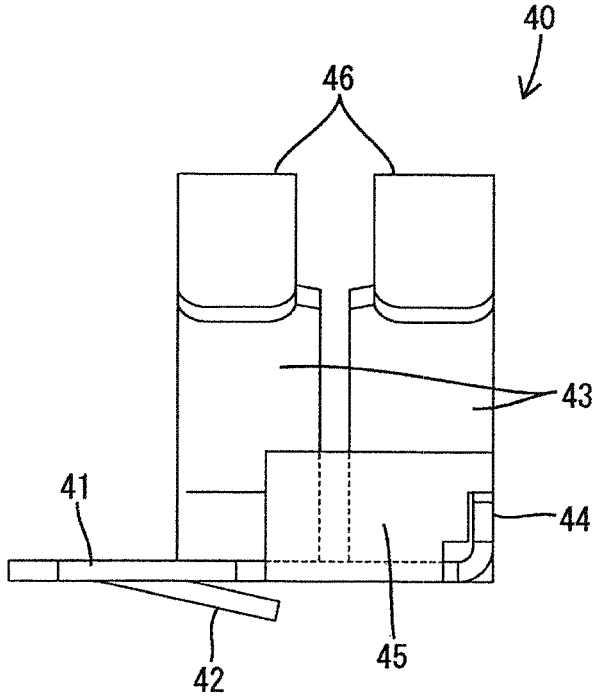
FIG. 19 is a front view of the short-circuiting terminal.
Figure 20:
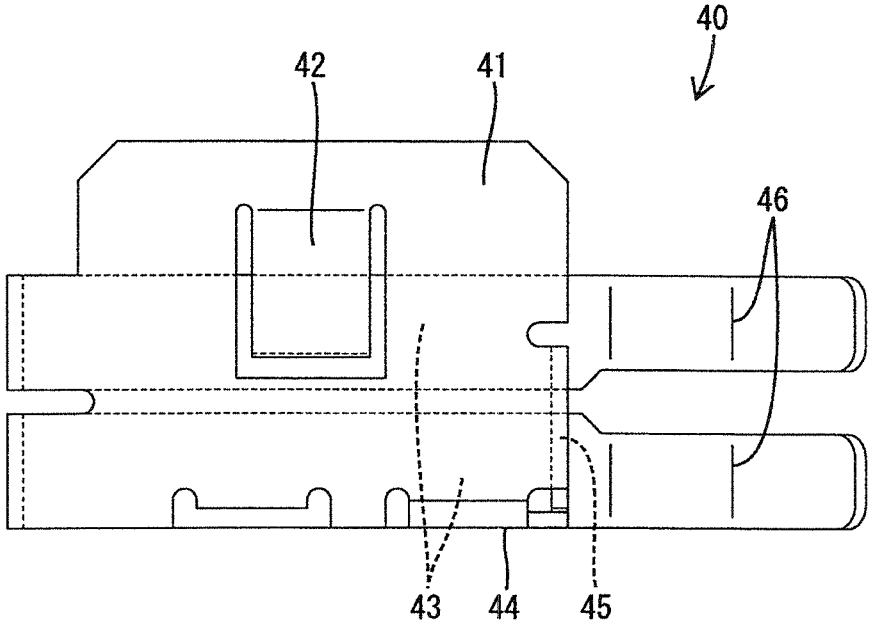
FIG. 20 is a bottom view of the short-circuiting terminal.

As shown in FIGS. 18 through 20, the short-circuiting terminal 40 has an approximately rectangular base plate 41, a locking strip 42, left and right elastic contact pieces 43, a jig contact part 44, and a reinforcing part 45. The locking strip 42 is formed by cutting and projecting a part of the base plate 41 to cantilever obliquely down and sideways. The elastic contact piece 43 extends obliquely up and forward from a rear edge of the base plate 41 and is elastically flexible in the vertical direction. Left and right elastic contact pieces 43 are coupled to each other at a rear end thereof through the base plate 41. A contact portion 46 is formed at a front-end of each elastic contact piece 43 and is bent in the shape of a mountain. The jig contact part 44 is erect in the shape of a plate from a rear end of one side edge of the base plate 41. The reinforcing part 45 is erect from the rear edge of the base plate 41 and locked to the jig contact part 44 to prevent a downward deformation of the jig contact part 44.

As shown in FIGS. 2, 5, and 13 through 17, the short-circuiting terminal 40 is mounted on the sub-housing 30. More particularly, the short-circuiting terminal 40 is mounted shallowly into the accommodation concavity 31 from a side opening thereof and a jig (not shown) is pressed against the jig contact part 44 with the elastic contact piece 43 being flexed toward the base plate 41. One of the side edges of the base plate 41 contacts a side surface of the accommodation concavity 31 and the locking strip 42 is locked to the locking hole 32 when the short-circuiting terminal 40 is pressed to a normal accommodation position. Thus, the short-circuiting terminal 40 is held and prevented from displacing in the left-to-right direction and the longitudinal direction. At this time, the elastic contact piece 43 elastically contacts the edge of an opening disposed on a front surface of the accommodation concavity 31. Thus, the short-circuiting terminal 40 is prevented from being displaced vertically relative to the sub-housing 30. The contact portion 46 of the elastic contact piece 43 projects out and forward from the sub-housing 30 when the short-circuiting terminal 40 is mounted completely the sub-housing 30. The front locking part 36F is positioned below the contact portion 46.

The first terminal fitting 50 is of known construction and has a quadrangular prism-shaped terminal body 51, a long and narrow tab 52 projected forward from the terminal body 51 and an open barrel-shaped crimping part 53 projected rearward from the terminal body 51, as shown in FIGS. 2 and 5. The first terminal fitting 50 is held by the terminal fitting holding part 11 with the tab 52 surrounded by the hood 12.

Figure 22:
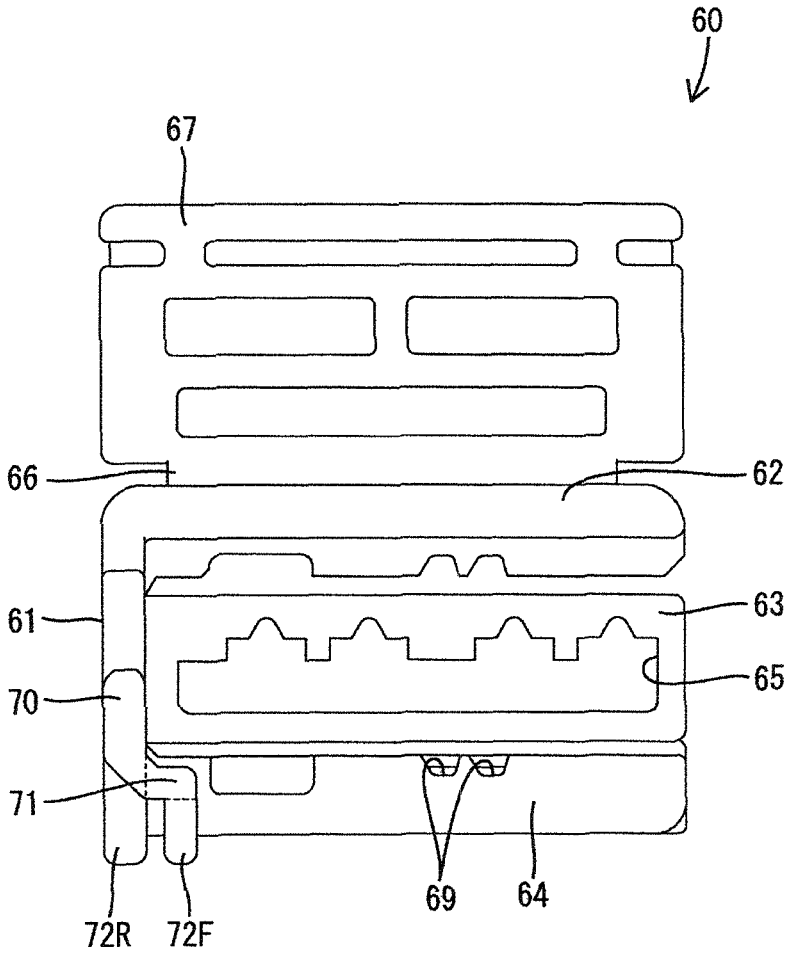
FIG. 22 is a front view of the retainer.
Figure 23:
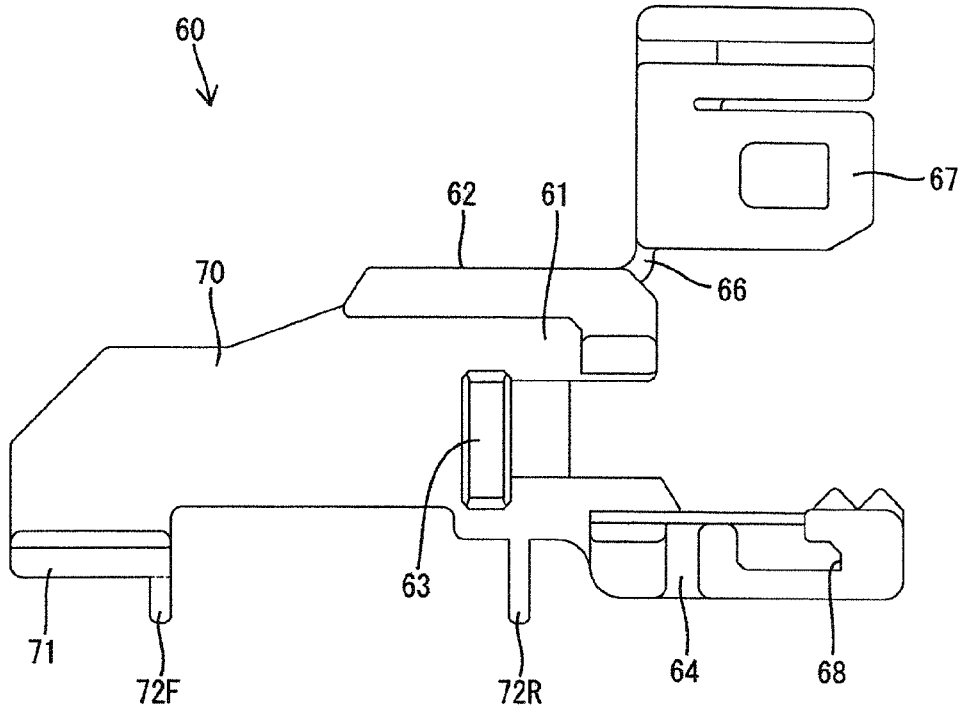
FIG. 23 is a right side view of the retainer.

The retainer 60 is made of synthetic resin. As shown in FIGS. 21 through 24, the retainer 60 has a side plate 61 and an upper plate 62 that is perpendicularly continuous with an upper edge of the side plate 61. A removal prevention frame 63 projects sideways from the side plate 61 in a direction parallel with the upper plate 62. A lower plate 64 projects sideways from a lower end of the side plate 61 and is parallel with the upper plate 62 and the removal prevention frame 63. As shown in FIG. 22, a terminal fitting penetration part 65 penetrates longitudinally through the removal prevention frame 63. The terminal fitting penetration part 65 is large and long in the left-to-right direction and an edge of the terminal fitting penetration part 65 is locked to the first terminal fitting 50. A hinge 66 is formed on the upper plate 62 and joins to an electric wire holding part 67 that can displace relative to the upper plate 62. A guide groove 68 extends in the left-to-right direction on the lower plate 64, as shown in FIG. 23. Left and right locking grooves 69 also are formed on the lower plate 64, as shown in FIG. 22.

Figure 21:
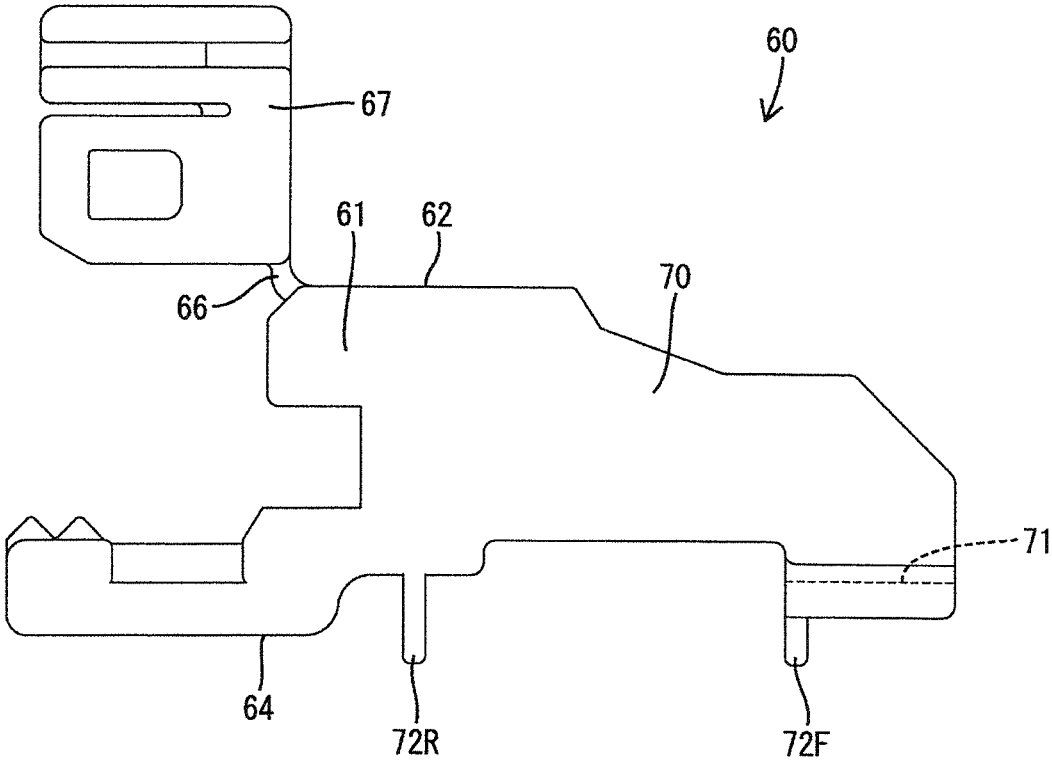
FIG. 21 is a left side view of the retainer.
Figure 24:
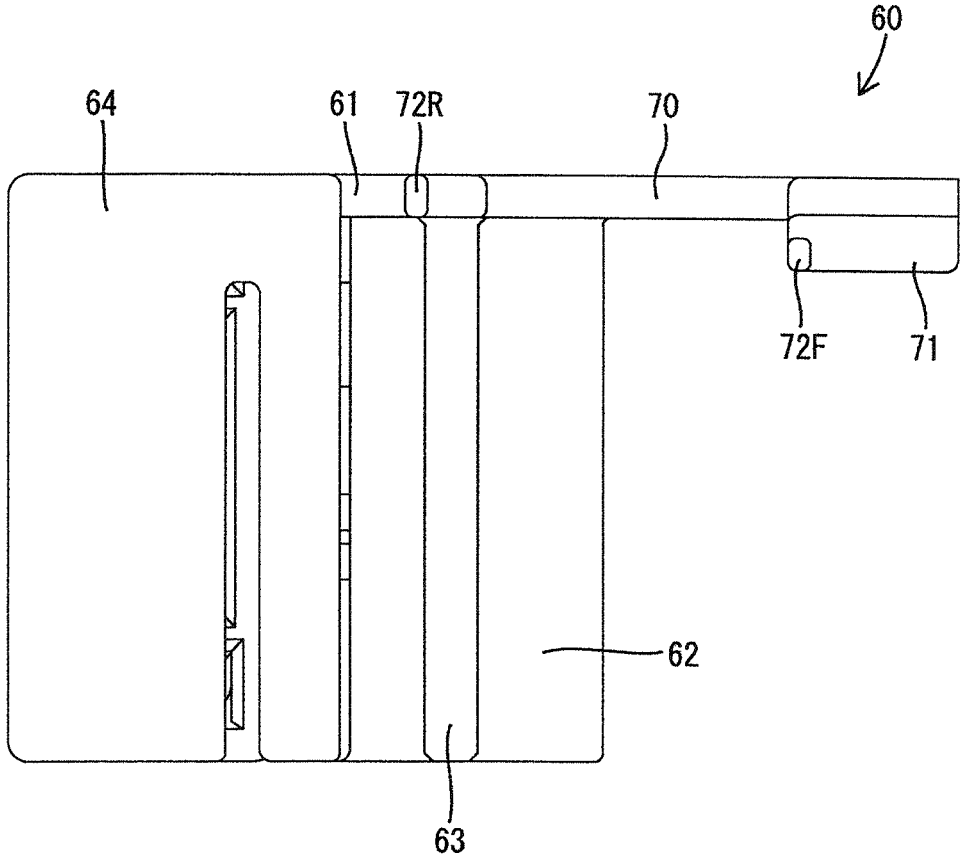
FIG. 24 is a bottom view of the retainer.

As shown in FIGS. 21, 23, and 24, an extended detection plate 70 is cantilevered forward from the side plate 61 and is flush with the side plate 61. The extended detection plate 70 is dimensioned and configured to cover the entire mounting/removing opening 18 of the accommodation chamber 17, as shown in FIGS. 6 and 9. The extended detection plate 70 extends perpendicular to the direction in which the retainer 60 is mounted in the accommodation chamber 17 and parallel with the direction in which the first and second housings 10 and 80 are fit together. A fit-on rib 71 is formed on an extended end of the extended detection plate 70 and projects in and sideways along a lower edge of an end of the extended detection plate 70. The fit-on rib 71 is at a region of the front-end portion covered with the tubular fit-on part 82 of the second housing 80 when housings 10 and 80 are fit normally together. As shown in FIG. 24, the extended detection plate 70 and the fit-on rib 71 form an approximately L-shape in a bottom view. Front and rear surfaces of the fit-on rib 71 extend in the left-to-right direction and in a direction perpendicular to the extended direction of the extended detection plate 70.

As shown in FIGS. 21 through 24, a long narrow rear detection part 72R projects down from a lower edge of the side plate 61 in a direction perpendicular to the direction in which the locking parts 36F and 36R elastically flex and a direction in which the retainer 60 is mounted on the first housing 10. A long narrow front detection part 72F projects down from a lower surface of the extended detection plate 70 in a direction parallel with the rear detection part 72R. The front detection part 72F is disposed forward from the rear detection part 72R in the longitudinal direction and is at a position inward from the rear detection part 72R in the left-to-right direction.

Figure 3:
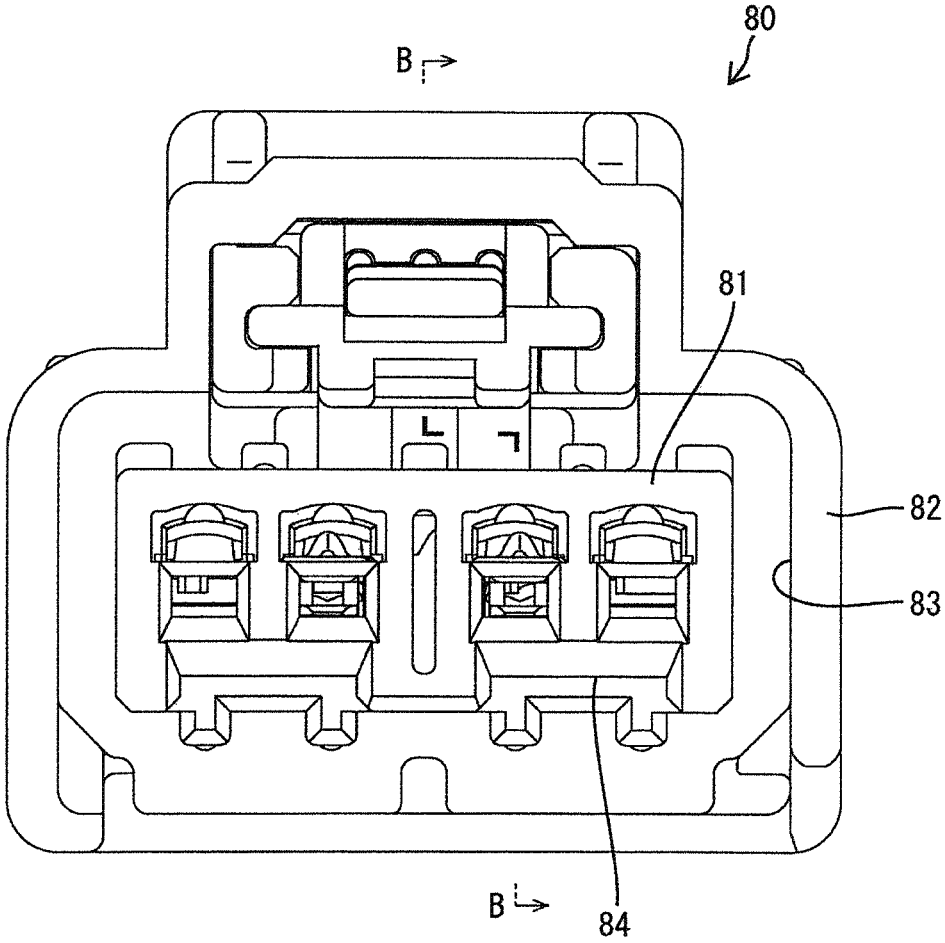
FIG. 3 is a front view of a second housing.
Figure 4:
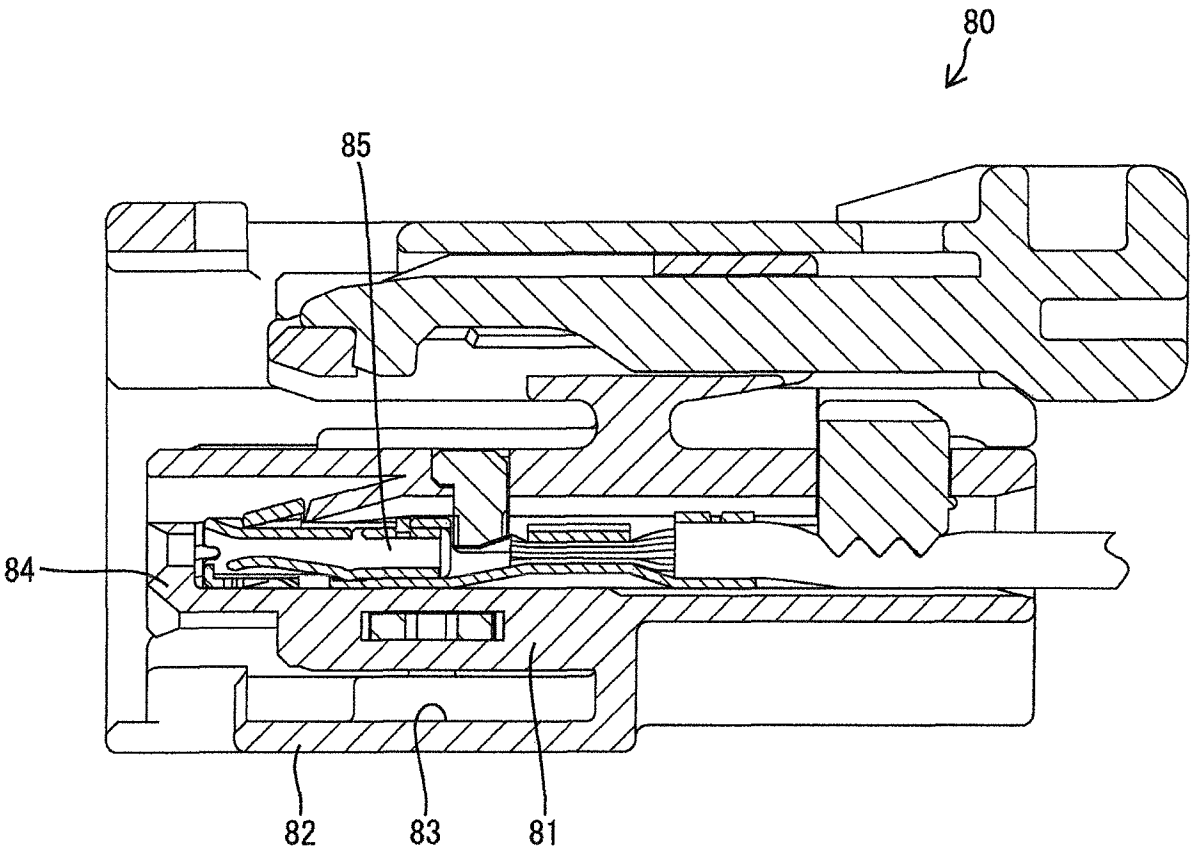
FIG. 4 is a sectional view taken along a line B-B of FIG. 3.

The second housing 80 is made of synthetic resin. As shown in FIGS. 3 through 5, the second housing 80 has a block-shaped terminal fitting accommodation part 81. A tubular fit-on part 82 is integral with the terminal fitting accommodation part 81 and surrounds the terminal fitting accommodation part 81. A tubular fit-on space 83 is formed between the periphery of the terminal fitting accommodation part 81 and the inner periphery of the tubular fit-on part 82 and opens forward (left in FIGS. 4 and 5). Two pairs of known female second terminal fittings 85 are accommodated inside the terminal fitting accommodation part 81 and are arranging in a row in the left-to-right direction (a direction orthogonal to the direction in which the housings 10 and 80 are fit together). A short-circuit release rib 84 is formed a little forward from the second terminal fitting 85 at a front part of the terminal fitting accommodation part 81 and functions to release the short circuit between the first terminal fitting 50 and the short-circuiting terminal 40.

The first housing 10 is assembled by initially mounting a short-circuiting terminal 40 on each of the two sub-housings 30. The two sub-housings 30 then are passed through the mounting/removing opening 18 from the lateral side of the first housing 10 and sequentially are inserted into the accommodation chamber 17. At this time, as shown in FIGS. 2, 6, and 7, the front and rear locking parts 36F, 36R are fit on the guide grooves 20 respectively and the prevention rib 39 is fit on the prevention groove 22.

The front and rear locking projections 38 interfere with the corresponding lock 21 in the process of inserting the first sub-housing 30 into the accommodation chamber 17. As a result, the front and rear locking parts 36F, 36R elastically flex into the flexing space 37. When the locking projections 38 pass through the locking part 21, the locking parts 36F, 36R elastically return to the original state thereof. When the first sub-housing 30 is pressed to a normal insertion position disposed at the inward side of the accommodation chamber 17, the first sub-housing 30 contacts the side wall portion 13. As a result, the first sub-housing 30 is stopped from moving forward in the insertion direction.

Thereafter the second sub-housing 30 is inserted into the accommodation chamber 17. The locking projections 38 interfere with the locking parts 21 and elastically flex in the process of inserting the second sub-housings 30 into the accommodation chamber 17 respectively. The second sub-housing 30 contacts the side surface of the first sub-housing 30 and the locking projections 38 pass through the respective locks 21 when the second sub-housing 30 reaches the normal insertion position shown in FIGS. 10 and 11. As a result, the locking parts 36F, 36R elastically return to their original state. Thereafter the locking projections 38 are locked to the respective locks 21 from the inward side of the accommodation chamber 17.

The contact between the first and second sub-housings 30 prevents the second sub-housing 30 from moving forward in the insertion direction. The locking of the locking projections 38 to the respective locks 21 prevents the second sub-housing 30 from being removed from the accommodation chamber 17. The locked engagement of the second sub-housing 30 in the accommodation chamber 17 in the vicinity of the mounting/removing opening 18 prevents the more inwardly disposed first sub-housing 30 from being removed. Thus, the two sub-housings 30 are passed through the mounting/removing opening 18 and are held in the accommodation chamber 17.

The two pairs of terminal fitting accommodation holes 33 of the sub-housings 30 and the two pairs of the terminal fitting insertion openings 26 of the first housing 10 are arranged longitudinally and communicate with each other when the two sub-housings 30 are mounted in the accommodation chamber 17, as shown in FIGS. 2 and 5. The terminal fitting accommodation holes 33 and the terminal fitting insertion openings 26 define the space for accommodating and holding the first terminal fitting 50 inside the terminal fitting holding part 11. In addition, the through-hole 35 of the sub-housing 30 and the escape hole 28 of the first housing 10 are arranged in the left-to-right direction.

The fit-on concavity 24 open on the outer side surface of the first housing 10 is between the front-end surface of the second sub-housing 30 (the side in the vicinity of the mounting/removing opening 18) and the step 23 when the two sub-housings 30 are mounted in the accommodation chamber 17, as shown in FIGS. 7 and 10. The step 23 and the front surface of the sub-housing 30 extend in the left-to-right direction (perpendicular to the extension direction of the extended detection plate 70). The longitudinal length of the fit-on concavity 24 is equal to that of the fit-on convex rib 71 of the retainer 60.

Figure 8:
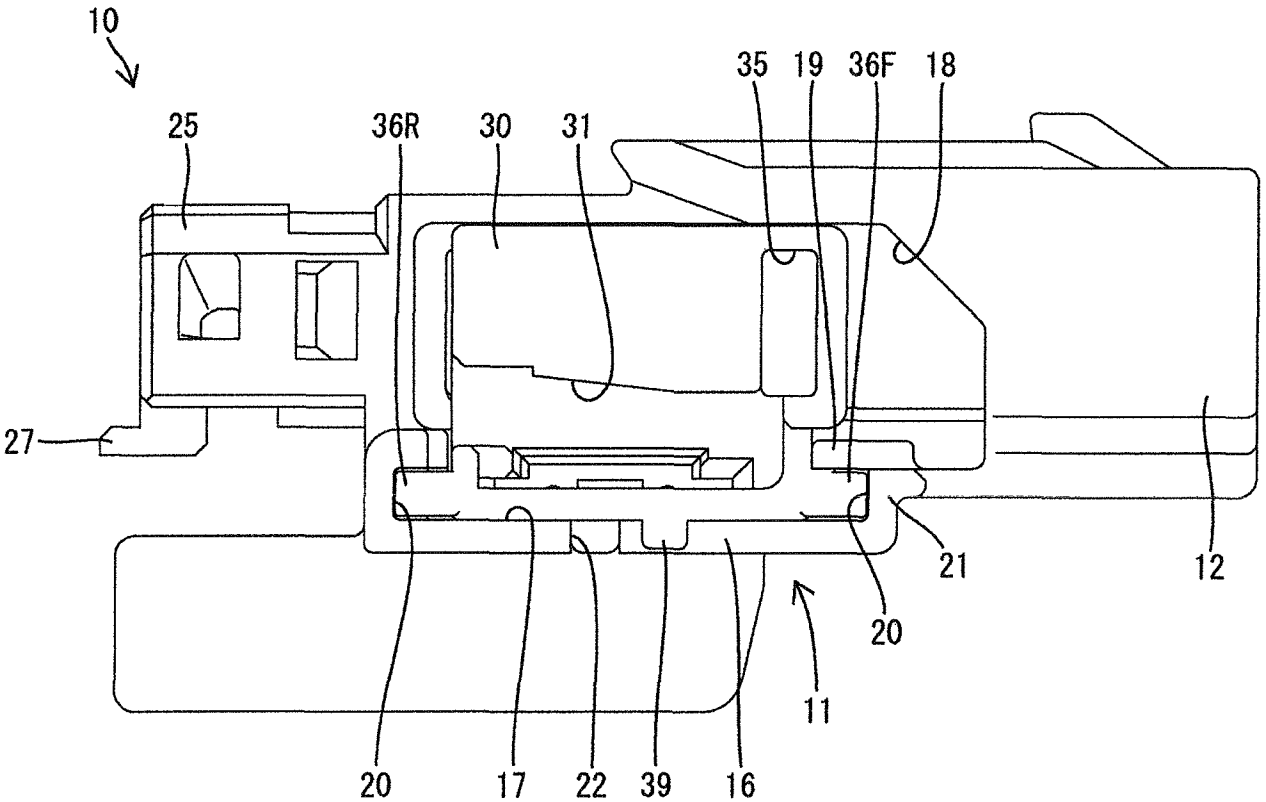
FIG. 8 is a left side view showing a state in which an operation of mounting the sub-housing on the first housing is being performed.

An attempt could be made to mount the sub-housing 30 in the accommodation chamber 17 in a longitudinally reversed orientation, as shown in FIG. 8 (the short-circuiting terminal 40 is not shown). In this orientation, the front and rear locking parts 36F and 36R can fit on the front and rear guide grooves 20. However, the prevention rib 39 is forward of the prevention groove 22 and interferes with the lower wall of the first housing 10 to prevent the sub-housing 30 from being mounted in the accommodation chamber 17 in a wrong orientation.

The opening disposed on the side surface of the accommodation concave part 31 of the sub-housing 30 faces the side opposite to the mounting/removing opening 18 in the left-to-right direction when the two sub-housings 30 are mounted in the accommodation chamber 17. The second sub-housing 30 is positioned nearer to the mounting/removing opening 18 than the first sub-housing 30 and the short-circuiting terminal 40 is hidden inside the second sub-housing 30 except the contact portion 46 of the elastic contact piece 43. Thus, foreign matter cannot interfere with the short-circuiting terminal 40 before the retainer 60 is mounted on the first housing 10.

The retainer 60 is mounted sideways in the first housing 10, as shown in FIGS. 6 and 9, after the sub-housings 30 are mounted in the accommodation chamber 17. More particularly, the guide groove 68 of the retainer 60 is fit on the guide rib 27 of the first housing 10, the upper plate 62 of the retainer 60 is slid along the upper surface of the upper wall 14, and the removal prevention frame part 63 of the retainer 60 is inserted into the through-hole 35 of the sub-housing 30 to keep the retainer 60 in a correct posture. The locking groove 69 of the retainer 60 is locked to a projection (not shown) on the lower surface of the terminal fitting insertion part 25 of the first housing 10. Thus, the retainer 60 is held by the first housing 10 at a temporary locking position.

The terminal fitting penetration part 65 of the retainer 60 communicates with the terminal fitting accommodation holes 33 and the terminal fitting insertion holes 26 when the retainer 60 is at the temporary locking position. At this time, the open region of the terminal fitting penetration part 65 includes the entire open region of the terminal fitting accommodation holes 33 and the terminal fitting insertion holes 26. Therefore the retainer 60 does not interfere with the first terminal fitting 50 being inserted into the first housing 10. The extended detection part 70 is at a position projected out from the outer side surface of the first housing 10. The projected position of the extended detection part 70 can interfere with the front end of the tubular fit-on part 82 when the housings 10 and 80 are fit together. The fit-on convex rib 71 of the retainer 60 is fit shallowly on the fit-on concavity 24 of the first housing 10 to prevent the retainer 60 from loosening.

Two pairs of the first terminal fittings 50 are inserted into the first housing 10 from the rear while the retainer 60 is at the temporary locking position. Thus, the tab 52 at the front end of each first terminal fitting 50 passes through the terminal fitting insertion hole 26, the terminal fitting accommodation hole 33, and the terminal fitting penetration part 65. Additionally, the lance 34 of the sub-housing 30 interferes with the terminal body 51 and flexes elastically up. The lance 34 elastically returns to its original state and locks to the terminal body 51 from the rear when the first terminal fitting 50 reaches the normal insertion position so that the first terminal fitting 50 cannot be removed. The tabs 52 of the first terminal fittings 50 press into contact with the contact portions 46 of the two elastic contact pieces 43 of the corresponding short-circuiting terminals 40 from above. Thus, the short-circuiting terminals 40 short circuit the pairs of the first terminal fittings 50.

The retainer 60 is pressed from the temporary locking position to the main locking position when all of the first terminal fittings 50 have been inserted into the first housing 10. The locking groove 69 of the retainer 60 locks the projection (not shown) of the first housing 10 when the retainer 60 reaches the main locking position to hold the retainer 60 at the main locking position. In this state, the edge of the terminal fitting penetration part 65 locks the terminal body 51 from the rear to prevent the first terminal fittings 50 from being removed from the first housing 10. Thus, the lance 34 and the retainer 60 securely prevent the first terminal fittings 50 from being removed from the first housing 10.

The outer surface of the extended detection part 70 is flush with the outer surface of the first housing 10, and the fit-on rib 71 is fit on the fit-on concavity 24 without loosening when the retainer 60 is pressed to the main locking position. At this time, the front and rear surfaces of the fit-on rib 71 make surface contact with the step 23 and the front surface of the sub-housing 30 respectively. The fit-on depth between the fit-on rib 71 and the fit-on concavity 24 in the left-to-right direction (the moving direction of the retainer 60 from the temporary locking position to the main locking position) when the retainer 60 is at the main locking position is larger than the fit-on depth when the retainer 60 is at the temporary locking position. The tight fitting of the fit-on rib 71 in the fit-on concavity 24 prevents the extended detection part 70 from inclining in the left-to-right direction on the rear end that is continuous with the side plate part 61. That is, the extended detection part 70 cannot displace out or incline relative to the first housing 10.

The side plate 61 and the extended detection plate 70 are disposed in the vicinity of the mounting/removing opening 18 when the retainer 60 is at the temporary locking position to prevent foreign matter from penetrating into the accommodation chamber 17. The entire mounting/removing opening 18 is covered by the side plate 61 and the extended detection plate 70 without a big clearance when the retainer 60 is pressed to the main locking position. Thus the sub-housing 30 and the short-circuiting terminal 40 are hidden by the retainer 60 and protected from foreign matter.

The front detection part 72F fits in the flexing space 37 of the front locking part 36F but the rear detection part 72R is not in the rear locking part 36R when the retainer is at the temporary locking position. The front detection part 72F moves to the inner side of the flexing space 37, and the rear detection part 72R is fit in flexing space 37 of the rear locking part 36R when the retainer 60 is pressed to the main locking position as shown in FIG. 11. The disposition of the front and rear detection parts 72F and 72R in the flexing space 37 prevents the front and rear locking parts 36F and 36R from flexing in an unlocking direction and away from the lock 21. Thus, the sub-housing 30 is locked securely in a state in the accommodation chamber 17 and cannot be shifted in a direction to separate from the accommodation chamber 17.

When the sub-housing 30 is inserted shallowly into the accommodation chamber 17 and when the front locking part 36F and the rear locking part 36R move into the flexing space 37, the front detection part 72F interferes with the front locking part 36F in mounting the retainer 60 on the temporary locking position. Thus an operation of mounting the retainer 60 on the temporary locking position cannot be performed smoothly. As a result, it is possible to detect a state in which the sub-housing 30 has been inserted into the accommodation chamber 17 incorrectly. When the removal prevention frame 63 and the lower plate 64 of the retainer 60 are pressed forcibly into the temporary locking position with the front detection part 72F interfering with the front locking part 36F, the extended detection part 70 inclines its posture, and thus the front-end of the extended detection part 70 separates greatly from the outer side surface of the first housing 10. Thus, it is possible to detect wrong mounting of the sub-housing 30 by viewing this state. When the sub-housing 30 is in a wrong mounting state, a pressing force to be imparted to the front-end portion (front detection part 72F) of the extended detection part 70 in a mounting direction should be increased. Therefore the front detection part 72F presses the front locking part 36F. Thus the sub-housing 30 can be moved to the normal insertion position.

The first and second housings 10 and 80 are fit together after the retainer 60 is mounted in the first housing 10. The terminal fitting accommodation part 81 is fit into the hood 12, and the tubular fit-on part 82 is fit on the hood 12 as the first and second housings 10 and 80 are fit together so that the hood 12 fits in the fit-on space 83. The front-end of the tubular fit-on part 82 approaches the front-end of the extended detection plate 70 from the outer side and is opposed thereto when the first and second housings 10 and 80 are fit normally together. In other words, the front-end of the extended detection plate 70 is accommodated in the tubular fit-on part 82. At this time, the fitting between the fit-on rib 71 and the fit-on concavity 24 prevents the extended detection plate 70 from being displaced to the outer surface side. Thus when the retainer 60 is mounted correctly at the main locking position, the extended detection plate 70 is kept flush with the outer side surface of the first housing 10 and does not interfere with the tubular fit-on part 82 when fitting the housings 10 and 80 together.

The short-circuit release part 84 of the second housing 80 contacts the contact portion 46 of the short-circuiting terminal 40 and flexes the elastic contact piece 43 down when the first and second housings 10 and 80 are fit normally together, as shown in FIG. 5. Thus, the first terminal fitting 5 is released from the short-circuited state and is connected electrically conductively to the second terminal fitting.

The two pairs of first terminal fittings 50 arranged in a row in the left-to-right direction and are short-circuited by the two short-circuiting terminals 40 arranged parallel with the left-to-right direction in which the first terminal fittings 50 are arranged. The two sub-housings 30 define means for holding the short-circuiting terminals 40. One accommodation chamber 17 is open on one of the outer side surfaces of the first housing 10 and has the mounting/removing opening 18 inside the first housing 10. The two sub-housings 30 are inserted into the accommodation chamber 17 parallel with the left-to-right direction in which the first terminal fittings 50 are arranged.

The two sub-housings 30 inserted into the accommodation chamber 17 have insulating properties and contact each other. Thus, the sub-housing 30 at the inward side of the accommodation chamber 17 is prevented from moving forward in the insertion direction, and the sub-housing 30 disposed in the vicinity of the mounting/removing opening 18 is prevented from being removed from the accommodation chamber 17. Hence, all of the short-circuiting terminals 40 are placed in position in the direction in which the short-circuiting terminals 40 are mounted in the accommodation chamber 17 and removed therefrom. Only one mounting/removing opening 18 is formed. Therefore, only the one extended detection part 70 of the retainer 60 is necessary for covering the mounting/removing opening 18.

The short-circuiting terminal 40 has two elastic contact pieces 43 that contact two first terminal fittings 50 and the base plate 41 that connects the elastic contact pieces 43 to each other. A sub-housing that accommodated the entire short-circuiting terminal 40 would be large. However, the base plate 41 is accommodated inside the sub-housing 30, and the contact portions 46 of the elastic contact pieces 43 project out from the sub-housing 30. Therefore, the sub-housing 30 can be made compact.

The projected locking part 36F is formed on the outer surface of the sub-housing 30 and is locked to the locking part 21 of the accommodation chamber 17 to prevent the sub-housing 30 from being removed from the accommodation chamber 17. Additionally, the projected locking part 36F is disposed vertically alongside the contact portions 46 of the elastic contact pieces 43 Foreign matter may approach the contact portion 46 from a position below the sub-housing 30. However, the locking part 36F prevents the foreign matter from reaching the contact portion 46.

The prevention groove 22 and the prevention rib 39 are formed on the inner surface of the accommodation chamber 17 and the outer surface of the sub-housing 30 and fit together in a concave-convex relationship only when the sub-housing 30 is inserted into the accommodation chamber 17 parallel with a left-to-right mounting/removing direction of the sub-housing 30 and when the sub-housing has a correct positional relationship with the accommodation chamber 17. However, the prevention groove 22 and the prevention rib 39 do not fit together, and the convex prevention rib 39 interferes with the edge of the mounting/removing opening 18 of the accommodation chamber 17 if an operator attempts to insert the sub-housing 30 into the accommodation chamber 17 in an incorrect positional orientation. Thus, the sub-housing 30 cannot be inserted into the accommodation chamber 17 in an incorrect posture.

The invention provides means for improving reliability of the detection function to be performed by the extended detection plate 70 of the retainer 60. When the extended front-end of the extended detection plate 70 is displaced incorrectly in the left-to-right direction, the extended detection plate 70 inclines in the left-to-right thickness direction of the extended detection plate 70. Thus, it is possible to prevent the extended end of the extended detection part from being incorrectly displaced by preventing the posture of the extended detection plate from inclining. Accordingly, the first housing 10 has the fit-on concavity 24 open on the outer surface thereof and the fit-on rib 71 on the extended detection plate 70 can be fit in the fit-on concavity 24 to prevent the extended detection plate 70 from being incorrectly displaced. Hence, the reliability of the detection function of the extended detection plate 70 is enhanced.

The first housing 10 has the accommodation chamber 17 open on the outer surface and the sub-housing 30 is inserted into the accommodation chamber 17. The clearance between the inner step 23 of the accommodation chamber 17 and the outer surface of the sub-housing 30 is formed as the fit-on concavity 24. Thus, it is possible to make the configuration of the outer surface of the first housing 10 simple.

The elastically flexible locking parts 36F and 36R are formed on the outer surface of the sub-housing 30 for holding the sub-housing 30 inside the accommodation chamber 17. The locking parts 36F and 36R elastically flex while inserting the sub-housing 30 into the accommodation chamber 17. The locking parts 36F and 36R elastically return to their original state when the sub-housing 30 is inserted correctly into the accommodation chamber 17. Further the extended detection part 70 has the front and rear detection parts 72F and 72R capable of moving into the flexing space 37 of the locking parts 36F and 36R when the retainer 60 is mounted correctly on the first housing 10. Accordingly, when the locking parts 36F and 36R elastically return to the original state, the front and rear detection part 72F and 72R move into the flexing space 37, and the retainer is mounted correctly on the first housing 10. When the locking parts 36F and 36R remain in an elastically flexed state, the front and rear detection parts 72F and 72R cannot move into the flexing space 37. Thus the retainer 60 cannot be mounted correctly on the first housing 10. Therefore, it is possible to detect the mounted state of the sub-housing 30 according to whether the retainer 60 has been correctly mounted on the first housing 10.

The invention is not limited to the embodiments described above with reference to the drawings. For example, the following embodiments are also included in the scope of the invention.

The fit-on rib is disposed at the end portion of the extended detection part in the illustrated embodiment. But the fit-on rib may be disposed at the proximal side thereof with respect to the end of the extended detection part.

One fit-on rib is formed on the extended detection part in the illustrated embodiment, but plural fit-on ribs may be formed on the extended detection part.

The clearance between the inner surface of the accommodation chamber and the outer surface of the sub-housing is effectively utilized as the fit-on concavity in the illustrated embodiment. But a dedicated fit-on concavity may be formed on the outer surface of the first housing.

The fit-on rib is fit shallowly on the fit-on concave part in the state in which the retainer is disposed at the temporary locking position in the illustrated embodiment. But it is possible to adopt a construction in which the fit-on rib is not fit on the fit-on concavity in the state in which the retainer is disposed at the temporary locking position.

The locking part is formed on the outer surface of the sub-housing in the illustrated embodiment, but may be formed on the inner surface thereof.

The sub-housing functions as the member for holding the short-circuiting terminal in the illustrated embodiment. However, the sub-housing may have function other than the function of holding the short-circuiting terminal.

Two sub-housings are accommodated inside one accommodation chamber in the illustrated embodiment. However, the number of sub-housings to be accommodated inside one accommodation chamber may be one, three or more.

One accommodation chamber is formed inside one housing in the illustrated embodiment. However, it is possible to form two accommodation chambers partitioned from each other with a partitioning wall. In this case, the number of the sub-housings to be accommodated inside each accommodation chamber may be one or more. The elastic contact piece of the short-circuiting terminal projects out of the sub-housing in the illustrated embodiment. However, the sub-housing may accommodate the entire short-circuiting terminal and the terminal fitting may contact the elastic contact piece inside the sub-housing.

The removal prevention part for preventing the removal of the sub-housing also prevents foreign matter from interfering with the elastic contact piece in the illustrated embodiment. But a dedicated means for preventing the foreign matter from interfering with the elastic contact piece may be provided separately from the removal prevention part.

The removal prevention part is elastically flexible, whereas the locking part is not elastically flexible in the illustrated embodiment. But it is possible that the removal prevention part is not elastically flexible, whereas the locking part is elastically flexible.

The mounting/removing opening of the accommodation chamber is closed with the retainer in the illustrated embodiment. But the mounting/removing opening may be closed with a member other than the retainer.

What is claimed is:

1. A connector comprising:

a housing having insulating properties and including opposite front and rear ends spaced apart along a longitudinal direction, the housing further including opposite first and second sides spaced apart along a lateral direction transverse to the longitudinal direction, a chamber formed in the housing and extending from a mounting opening at the first side of the housing to a wall at the second side of the housing;

at least one pair of terminal fittings accommodated inside said housing and extending substantially in the longitudinal direction;

at least one sub-housing having insulating properties and disposed in the chamber of the housing, the sub-housing including opposite first and second sides spaced apart along the lateral direction, a cavity formed in the sub-housing and an opening at the second side of the sub-housing communicating with the cavity, the sub-housing being configured for insertion through the mounting opening of the housing for mounting in the chamber; and a short-circuiting terminal having a base plate in the cavity of the housing and configured for insertion through the opening at the second side of the sub-housing, at least one elastic contact piece extending from the base plate and projecting forward of the sub-housing and into resilient contact with the terminal fittings.

2. The connector of claim 1, wherein said short-circuiting terminal has two elastic contact pieces that contact the pair of said terminal fittings and a connection part that connects said elastic contact pieces to each other; and said connection part is accommodated inside said sub-housing, and said elastic contact pieces project out from said sub-housing.

3. The connector of claim 2, wherein a removal prevention part projects on an outer surface of said sub-housing alongside at least one of said elastic contact pieces, the removal prevention part being locked to a locking part of said chamber to prevent said sub-housing from being removed from said chamber.

4. The connector of claim 1, wherein wrong insertion prevention parts are formed on an inner surface of said chamber and an outer surface of said sub-housing respectively and extend parallel to a direction in which the sub-housing is mounted in and removed from said chamber; said wrong insertion prevention parts being fit together in a concave-convex relationship only when said sub-housing is inserted into said chamber in a correct positional relationship.

5. The connector of claim 1, wherein the housing has a wall adjacent the second side of the housing and opposed to the opening to the chamber, the sub-housing being accommodated in the chamber of the housing so that the opening at the second side of the sub-housing is facing the wall of the housing.

6. The connector of claim 5, wherein the at least one sub-housing is a first sub-housing and the connector further comprising a second sub-housing accommodated in the chamber of the housing, the second sub-housing having opposite first and second sides spaced apart along the lateral direction, a cavity formed in the second sub-housing and an opening at the second side of the second sub-housing communicating with the cavity, the second sub-housing being configured for insertion through the mounting opening of the housing for mounting in the chamber at a position substantially adjacent the first sub-housing.

7. The connector of claim 6, wherein the opening at the second side of the second sub-housing faces the first side of the first sub-housing.

8. The connector of claim 1, wherein the at least one sub-housing is a first sub-housing and the connector further comprising a second sub-housing accommodated in the chamber of the housing, the second sub-housing having opposite first and second sides spaced apart along the lateral direction, a cavity formed in the second sub-housing and an opening at the second side of the second sub-housing communicating with the cavity, the second sub-housing being configured for insertion through the mounting opening of the housing for mounting in the chamber at a position substantially adjacent the first sub-housing.

9. The connector of claim 8, wherein the short-circuiting terminal is a first short-circuiting terminal and the base plate of the first short-circuiting terminal is accommodated in the cavity of the first sub-housing, the connector further comprising a second short-circuiting terminal having a base plate accommodated in the cavity of the second sub-housing.

10. The connector of claim 1 further comprising a retainer mounted in the mounting opening of the housing, the retainer having a terminal fitting penetration part that locks rear ends of the terminal fittings to prevent removal of the terminal fittings from the housing.

11. The connector of claim 10, wherein the sub-housing has at least one elastically flexible locking part that is resiliently engageable with the housing when the sub-housing is mounted properly in the chamber of the housing, the retainer having at least one detection part that is movable into a flexing space for the locking part when the sub-housing is mounted properly in the chamber of the housing, the detection part being blocked from entry into the flexing space when the sub-housing is not mounted completely in the chamber, thereby providing an indication of incomplete mounting of the sub-housing.

12. The connector of claim 10, wherein the retainer is configured for closing the mounting opening of the housing.

13. The connector of claim 1, wherein the sub-housing has a front opening communicating with the opening at the second side of the sub-housing and communicating with the cavity, the elastic contact piece of the short-circuiting terminal projecting through the front opening of the sub-housing.

14. The connector of claim 13, wherein the short-circuiting terminal has a locking strip cantilevered obliquely from the base plate toward the second side of the sub-housing, the locking strip being resiliently engaged with a locking hole of the sub-housing for retaining the short-circuiting terminal in the cavity.

15. The connector of claim 1, wherein the sub-housing has two laterally spaced terminal fitting accommodation holes extending in the longitudinal direction and accommodating the respective terminal fittings.

* * * * *